United States Patent [19]

Osborn et al.

[11] 4,250,251

[45] Feb. 10, 1981

[54] PHENYLSULFAMOYL COUPLERS, COUPLER COMPOSITIONS AND PHOTOGRAPHIC ELEMENTS SUITED TO FORMING INTEGRAL SOUND TRACKS

[75] Inventors: Harland J. Osborn, Rochester; Robert G. Cameron, Spencerport; Edward J. Walsh, Pittsford, all of N.Y.

[73] Assignee: Eastman Kodak Company, Rochester, N.Y.

[21] Appl. No.: 56,587

[22] Filed: Jul. 11, 1979

Related U.S. Application Data

[63] Continuation-in-part of Ser. No. 928,741, Jul. 27, 1978, abandoned.

[51] Int. Cl.[3] ..... G03C 1/40

[52] U.S. Cl. ..... 430/449; 430/140; 430/505; 430/553; 430/944; 430/546

[58] Field of Search ..... 430/552, 553, 140, 449, 430/944, 505, 546

[56] References Cited

U.S. PATENT DOCUMENTS

| | | | |
|---|---|---|---|
| 2,266,452 | 12/1941 | Vittum et al. | 430/552 |
| 2,373,821 | 4/1945 | Frohlich et al. | 430/552 |
| 2,993,791 | 7/1961 | Coles et al. | 430/552 |
| 3,556,796 | 1/1971 | Eynde et al. | 430/552 |
| 3,622,328 | 11/1971 | Pollet et al. | 430/553 |
| 3,767,411 | 10/1973 | Kishimoto et al. | 430/553 |
| 3,844,795 | 10/1974 | Puschel et al. | 430/553 |
| 4,178,183 | 12/1979 | Ciurca et al. | 430/140 |

FOREIGN PATENT DOCUMENTS

| | | | |
|---|---|---|---|
| 48-59838 | 8/1973 | Japan | 430/552 |
| 1424454 | 2/1976 | United Kingdom | 430/140 |

*Primary Examiner*—J. Travis Brown
*Attorney, Agent, or Firm*—Carl O. Thomas

[57] ABSTRACT

Ballasted primary and secondary 3'-sulfamoyl-1-hydroxy-2-naphthanilide couplers are disclosed as well as compositions and photographic elements containing these couplers in coupler solvent particles. The coupler solvent particles are comprised of a combination of a coupler solvent and the coupler capable of permitting the formation of a microcrystalline dye. Surprisingly these microcrystalline dyes exhibit a broadened absorption characteristic in the 750 to 850 nm region of the spectrum. Dye images having such absorption characteristics are particularly suited to forming integral infrared absorbing sound tracks in photographic elements, such as motion picture projection films.

21 Claims, 11 Drawing Figures

PHENYLSULFAMOYL COUPLERS, COUPLER COMPOSITIONS AND PHOTOGRAPHIC ELEMENTS SUITED TO FORMING INTEGRAL SOUND TRACKS

CROSS-REFERENCE TO RELATED APPLICATION(S)

This application is a continuation-in-part of our application Ser. No. 928,741, filed July 27, 1978, now abandoned.

FIELD OF THE INVENTION

This invention relates to photographic elements and compositions adapted to form infrared absorbing dyes, particularly those useful in forming integral dye sound track motion picture films, and to couplers particularly suited for forming microcrystalline infrared absorbing dyes when dispersed in coupler solvents.

BACKGROUND OF THE INVENTION

In black-and-white motion picture projection films it is frequently desirable to provide an integral sound track. Both the photographic image and sound track images in the film are silver. The sound track, which can be of variable density or variable area, is read optically by a photocell which detects infrared radiation passing therethrough. The peak sensitivity of these photocells, generally referred to as S-1 photocells, is typically at about 800 nm plus or minus 50 nm. The wide variance in peak absorption is of little importance, since silver has a substantially uniform absorption in the infrared region of the spectrum.

In color photography, instead of employing silver images, as in black-and-white photography, the oxidized developing agent which is generated in imagewise developing silver halide to silver is used to form a dye image. The formation of color photographic images by imagewise reaction (coupling) of oxidized aromatic primary amine developing agents with incorporated color-forming couplers to form dyes is well known. In these processes, the subtractive process of color formation is ordinarily used, and the image dyes customarily formed are cyan, magenta and yellow, the colors that are complementary to the primary colors, red, green and blue, respectively. The silver image which is formed by development is an unwanted by-product which is removed by bleaching.

In color motion picture projection films it is conventional to employ a silver sound track. The rquirement that silver be retained in the optical sound track of the motion picture film is distinctly disadvantageous because the developed silver must be removed from the picture area without disturbing the silver in the optical sound track. This has given rise to processing techniques which require the separate treatment of a portion of the film at least once during processing in order to obtain a silver sound track.

The desirability of employing dye sound tracks in color motion picture projection films, particularly dye sound tracks compatible with projection equipment now in use designed for films having silver sound tracks, has been long recognized. Unfortunately, the subtractive dyes which form the picture image have their regions of maximum absorption in the range of from about 400 to 700 nm and are relatively transparent in the infrared region where the S-1 photocells are most sensitive. In looking for dyes suitable for use in forming infrared absorbing sound tracks for color motion picture projection films two principal obstacles have been encountered. First, the dyes have for the most part lacked sufficient peak absorption in the required region of the spectrum. Second, the absorption peaks of the dyes have not been broad enough to accomodate the plus or minus 50 nm variation in peak sensitivity of S-1 photocells. Infrared absorbing dyes which have been disclosed for use in forming integral dye sound tracks are illustrated by Vittum et al U.S. Pat. No. 2,266,452, issued Dec. 16, 1941, and Frohlich et al U.S. Pat. No. 2,373,821, issued Apr. 17, 1945. More recent disclosures which address maximum absorption peak densities, but which do not address the breadth of the absorption peak, are illustrated by Japanese Publication No. 59838, laid open Aug. 22, 1973, based on patent application No. 94266, filed Nov. 24, 1971, and U.K. Pat. No. 1,424,454.

BRIEF DESCRIPTION OF THE INVENTION

In one aspect, this invention is directed to a photographic element comprising a support and, coated thereon, at least one layer unit which comprises a photographic silver halide emulsion layer and coupler solvent particles dispersed in a photographically useful amount in the emulsion layer or in an adjacent hydrophilic colloid layer. The photographic element is characterized by the improvement wherein the coupler solvent particles are comprised of a combination of a coupler solvent and a noncrystalline ballasted primary or secondary 3'-sulfamoyl-1-hydroxy-2-naphthanilide coupler capable of permitting the formation of a microcrystalline dye.

In another aspect, this invention is directed to a composition, which can be coated to form a layer of a photographic element, comprising a hydrophilic colloid and coupler solvent particles dispersed therein in a photographically useful amount comprised of a combination of a coupler solvent and a noncrystalline ballasted primary or secondary 3'-sulfamoyl-1-hydroxy-2-naphthanilide coupler capable of permitting the formation of a microcrystalline dye.

In a preferred form, the coupler is of the formula

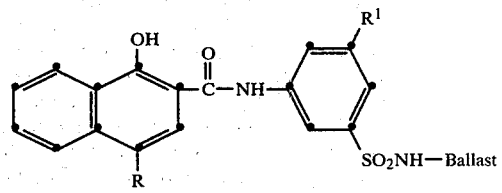

wherein R is a coupling-off group, $R^1$ is either hydrogen or —$SO_2NH$—Ballast and Ballast is a hydrophobic photographic ballasting group; the coupler solvent is chosen from the group consisting of

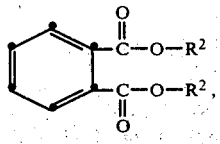

-continued

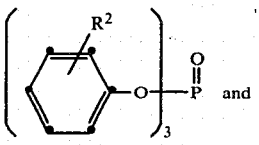

and

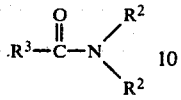

wherein $R^2$ is hydrogen or lower alkyl of from 1 to 6 carbon atoms and is lower alkyl in at least one occurrence, $R^3$ is a straight-chain alkyl group of from 7 to 15 carbon atoms; and the coupler and the coupler solvent are present in a weight ratio of the range of from 5:1 to 1:2.

In still another aspect, this invention is directed to a photographically useful dye-forming coupler capable of forming a dye having an absorption peak in the infrared portion of the spectrum of the formula:

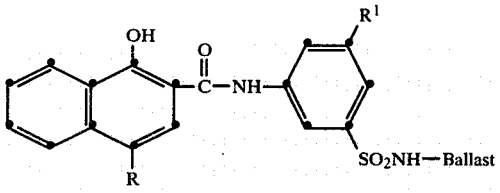

wherein R is a coupling-off group, $R^1$ is either hydrogen or —$SO_2NH$—Ballast and Ballast is a hydrophobic photographic ballasting group.

It is a surprising feature of this invention that the microcrystalline dyes which can be formed with coupler-coupler solvent combinations identified above have absorption peaks in the infrared portion of the spectrum and, when incorporated in a photographic element, are capable of producing densities at 800 nm well above 1.0. It is still more surprising that broad absorption peaks can be produced in the 800 nm region of the spectrum. Particularly, it is surprising that these coupler-coupler solvent combinations can produce infrared absorbing dye images having sufficient peak densities and spectral peak breadth to be useful in modulating the response of an S-1 photocell when coated in a photographic element to form a sound track. The present invention offers the specific advantage of permitting color motion picture projection films to be formed with integral infrared absorbing dye sound tracks, thereby eliminating the disadvantages in processing of selectively retaining silver in sound track areas and offering the distinct advantage of allowing such integral infrared absorbing dye sound track color motion picture films to be employed in projection equipment having S-1 and similar photocells intended for modulation with a silver sound track.

DESCRIPTION OF THE PREFERRED EMBODIMENTS

Figure 1:
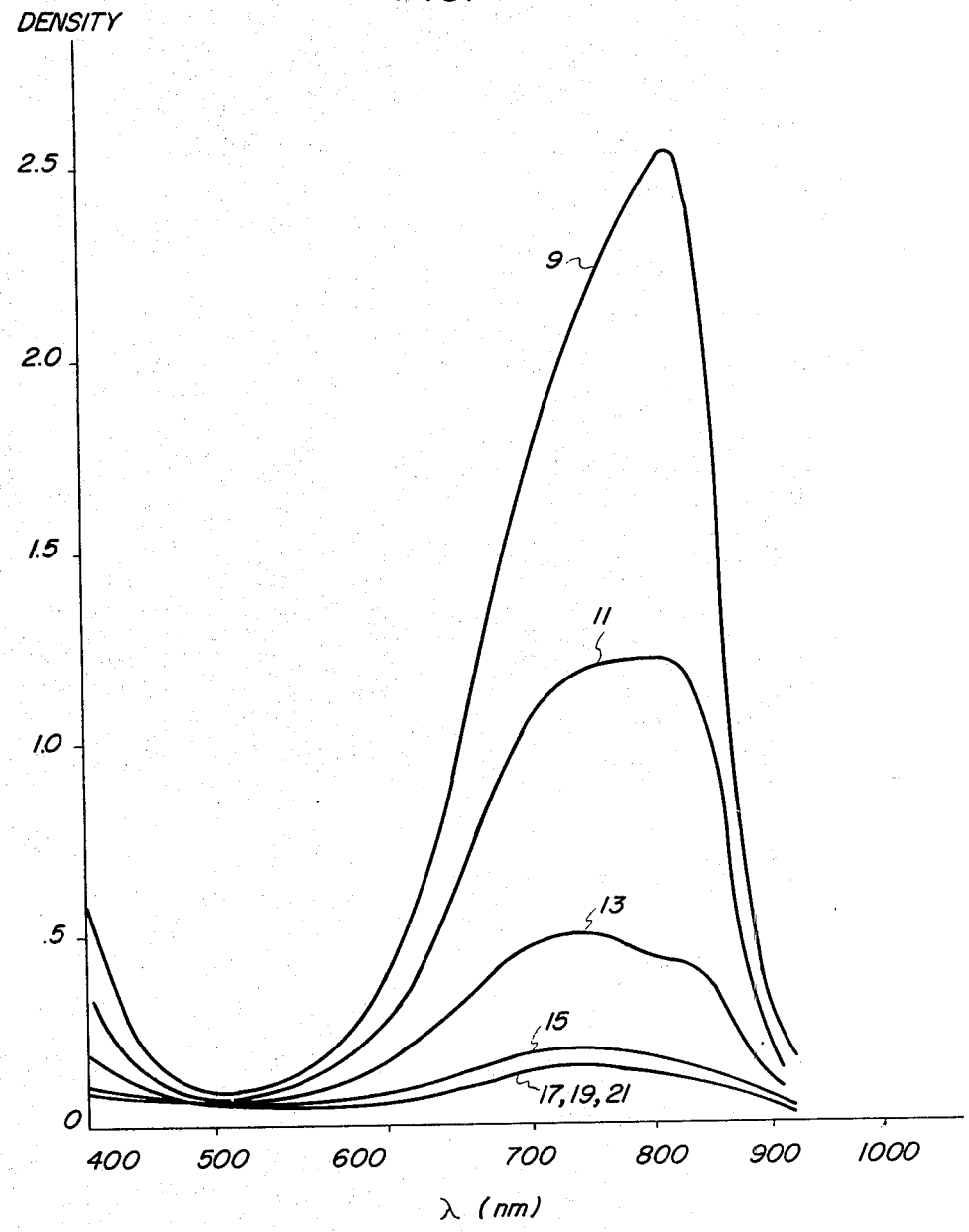
FIGS. 1 through 11 show dye absorption curves produced by plotting density on an ordinate versus wavelength as an abscissa.

Any noncrystalline ballasted primary or secondary 3'-sulfamoyl-1-hydroxy-2-naphthanilide coupler capable of reacting in a coupler solvent particle with an oxidized color developing agent to form a microcrystalline infrared absorbing dye can be employed in the practice of this invention. The preferred couplers contemplated for use in forming microcrystalline infrared absorbing dyes are novel ballasted secondary 3'-sulfamoyl-1-hydroxy-2-naphthanilide couplers of the following formula:

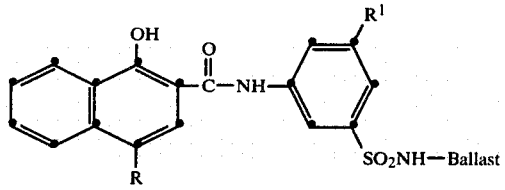

wherein

R is a coupling-off group, $R^1$ is either hydrogen or —$SO_2NH$—Ballast and

Ballast is a hydrophobic photographic ballasting group.

Coupling-off groups, represented by R, are well known to those skilled in the art. Such groups are displaced when the coupler reacts with oxidized color developing agent. Thus, the coupling-off group is not included in the dye formed by this reaction. The coupling-off group can perform useful photographic functions, such as determining the equivalency of the coupler (e.g., determining if the coupler is a two-equivalent or a four-equivalent coupler), modifying the reactivity of the coupler or releasing a photographically useful fragment which can modulate other characteristics, such as inhibiting or accelerating bleaching, inhibiting development, color correction and the like. Representative of useful conventional coupling-off groups are hydrogen, alkoxy, aryloxy, arylazo, thioether and heterocyclic groups, such as oxazoyl, diazolyl, triazolyl and tetrazolyl groups. Hydrogen is a preferred coupling-off group.

Ballast in the general formula above can be chosen from conventional hydrophobic photographic ballasting groups. Such groups inhibit the diffusion of the couplers when incorporated in a hydrophilic colloid layer of a photographic element. Typical useful ballast groups include long-chain alkyl radicals linked directly or indirectly to the compound as well as aromatic radicals of the benzene and naphthylene series. Such ballast groups commonly have at least 8 carbon atoms in aggregate. That is, in the form of the couplers shown above where two ballast groups are present, the sum of the ballast carbon atoms should be at least 8, but, where only a single ballast group is present, this group should alone have at least 8 carbon atoms. The ballast groups should in aggregate have from about 8 to 32 carbon atoms, preferably from about 10 to 28 carbon atoms. In one specifically contemplated form the ballast groups are straight-chain alkyl radicals having from 6 to 16 carbon atoms in a single ballast group, optimally from about 8 to 12 carbon atoms. In another preferred form the ballasting group is of the following formula:

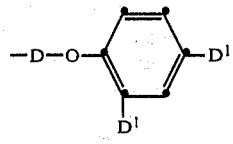

wherein

D is a divalent lower alkylene group of from 1 to 6 carbon atoms and $D^1$ is a monovalent lower alkyl group of from 1 to 6 carbon atoms.

The alkylene group can be methylene, ethylene or any of the isomeric forms of propylene, butylene, pentylene or hexylene. The lower alkyl group can be methyl, ethyl or any of the isomeric forms of propyl, butyl, amyl and hexyl groups.

The couplers can be chemically synthesized by techniques well known to those skilled in the art. For example, the synthesis of m-[N-δ-(2',4'-di-t-amylphenoxy)-butylsulfamyl]-1-hydroxy-2-naphthanilide, m-{N-[β-(2,4-di-t-amylphenoxy)butylsulfamyl]}-1-hydroxy-2-naphthanilide, di-[m-(N-n-dodecyl)sulfamyl]-1-hydroxy-2-naphthanilide and di-[m-(N-n-octyl)sulfamyl]-1-hydroxy-2-naphthanilide set forth below can be readily adapted to the synthesis of other of the novel couplers merely by varying the substituents in the starting materials which provide the coupling-off and/or ballasting groups.

The preferred coupler solvents contemplated for use in combination with the above couplers include lower alkyl esters of phthalic acid, lower alkyl substituted triphenyl phosphates and lower alkyl N-substituted aliphatic amides having at least 10 carbon atoms. Specifically preferred coupler solvents can be chosen from among

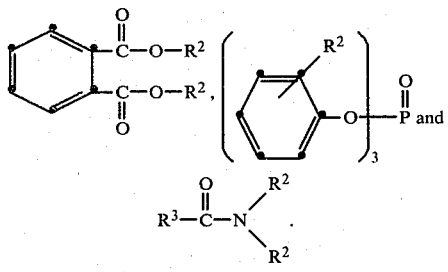

$R^2$ is hydrogen or lower alkyl of from 1 to 6 carbon atoms and is lower alkyl in at least one occurrence. The lower alkyl groups can be methyl, ethyl and any of the various isomeric forms of propyl, butyl, amyl and hexyl groups. It is preferred that $R^2$ in each occurrence be a lower alkyl group. $R^3$ is a straight-chain alkyl group of from 7 to 15 carbon atoms, preferably from 9 to 13 carbon atoms.

The following are exemplary of preferred coupler solvents contemplated for use:

dimethyl phthalate
diethyl phthalate
di-n-butyl phthalate
di-i-amyl phthalate
n-amyl phthalate
tri-o-cresyl phosphate
tri-m-cresyl phosphate
tri-p-cresyl phosphate
o-cresyl diphenyl phosphate
N,N-diethyl lauramide
N,N-di-n-butyl lauramide
N,N-diethyl capramide Other conventional coupler solvents are capable of permitting associated ballasted primary or secondary 3'-sulfamoyl-1-hydroxy-2-naphthanilide couplers to form microcrystalline dyes can be employed. Coupler to coupler solvent weight ratios of from 5:1 to 1:2 are generally preferred. For the lower alkyl esters of phthalic acids employed as coupler solvents it is preferred that the coupler to solvent weight ratio be in the range of from 1:1 to 1:2. For the triphenyl phosphate coupler solvents it is preferred that the weight ratio of coupler to coupler solvent be in the range of from 4:1 to 1:1. For the N-substituted aliphatic amides it is preferred that the weight ratio of coupler to coupler solvent be in the range of from 4:1 to 2:1.

Coupler solvents of the type described above and techniques for dissolving couplers therein are known to those skilled in the art. Techniques are also well known for dispersing coupler-containing coupler solvents in hydrophilic colloid-containing coating compositions useful in forming photographic elements. The coupler-containing coupler solvent is typically dispersed in the hydrophilic colloid-containing coating composition in the form of particles of relatively small size, typically from about 0.3 to about 3.0 microns in mean diameter, usually by colloid milling. The coupler solvents herein employed, the dispersion of couplers therein, the introduction of the coupler-containing coupler solvents into hydrophilic colloid-containing coating compositions and the coating of the composition to form layers in photographic elements, are illustrated by Mannes et al U.S. Pat. No. 2,304,940, issued Dec. 15, 1942; Jelley et al U.S. Pat. No. 2,322,027, issued June 15, 1943; Vittum et al U.S. Pat. No. 2,801,170, issued July 30, 1957; Fierke et al U.S. Pat. No. 2,801,171, issued July 30, 1957; Thirtle et al U.S. Pat. No. 2,835,579, issued May 20, 1958; and Julian U.S. Pat. No. 2,949,360, issued Aug. 16, 1960, as well as the Japanese Publication No. 59838 and U.K. Pat. No. 1,424,454, both cited above, the disclosures of each of the above here being incorporated by reference.

In a simple form the photographic elements of this invention are comprised of a photographic support having coated thereon a single layer unit which comprises a photographic silver halide emulsion containing therein in a photographically useful amount particles which are comprised of the coupler and coupler solvent combined in the weight ratio described above. In a variant form, well known in the art, instead of incorporating the coupler-containing coupler solvent particles directly in the silver halide emulsion layer, the particles can be dispersed in a hydrophilic colloid layer immediately adjacent to the silver halide emulsion layer. In this form the hydrophilic colloid layer containing the particles and the silver halide emulsion layer together form the layer unit.

Such a single layer unit element can be employed for the sole purpose of forming a sound track or, preferably, the element can be employed to form both a photographic image and a sound track. It is possible with such an element to form an infrared absorbing dye sound track and a silver photographic image or, alternatively, a silver sound track and an infrared absorbing photographic dye image. In a specifically preferred use an integral dye sound track is formed. As employed herein, the term "integral sound track" indicates that a sound track and a photographic image are formed in separate portions of the same element and that following exposure the separate areas are concurrently and identically processed (i.e., requiring no process steps other than those required for processing the photographic image portion) to form sound track and photographic records, respectively. Since the novel couplers employed in the practice of this invention produce dyes which absorb not only in the infrared, but also in the visible portion of the spectrum, both a sound track and a photographic image can be formed solely by the dye. For example, an integral sound track and photographic image can be formed by the dye, the sound track portion being read by an S-1 or similar infrared responsive photocell and the photographic image being read by the eye as a projected dye image. Other variant uses will readily occur to those skilled in the art.

In a form capable of recording multicolor images the photographic element contains in addition to the support and the single layer unit described above at least two additional layer units, and the photographic element is capable of producing multicolor photographic images. The single layer unit described above can contain a red-sensitized silver halide emulsion and be employed to form a cyan dye image as well as an infrared absorbing dye image. The same dye can form both the cyan and the infrared absorbing dye image, but is is preferred in that instance that the single layer unit described above be modified to include in addition a conventional cyan dye-forming coupler. The cyan dye-forming coupler is preferably dispersed in separate coupler solvent particles from those containing the infrared absorbing dye-forming coupler or coated without employing a coupler solvent. A second layer unit is present containing a blue-sensitive silver halide emulsion and a yellow dye-forming coupler, and a third layer unit is present containing a green-sensitized silver halide emulsion and a magenta dye-forming coupler. The construction of the second and third layer units and their relationship to the first layer unit is conventional and requires no detailed description.

In another form, which is specifically preferred, the photographic element is provided with four separate layer units. Three layer units are conventional cyan, magenta and yellow dye-forming layer units of the type found in conventional silver halide photographic elements intended to form multicolor dye images. The fourth layer unit can be identical to the single layer unit described above. In a preferred form the silver halide emulsion in the fourth layer unit is sensitized to a portion of the spectrum to which the remaining layers are relatively insensitive. For example, the fourth layer unit emulsion can be spectrally sensitized to the infrared portion of the spectrum or to portions of the visible spectrum which lie at the fringes of the spectral regions the remaining layer units are intended to record. The blue portion of the spectrum is nominally defined as from 400 to 500 nm, the green portion of the spectrum from 500 to 600 nm and the red portion of the spectrum from 600 to 700 nm. The spectral regions in the vicinity of about 500 nm and 600 nm are frequently relatively insensitive to light as compared to the mid-regions of the blue, green and red portions of the spectrum. This is done intentionally to avoid recording in a layer unit light exposure from one of the two remaining thirds of the visible spectrum. By spectrally sensitizing the emulsion of the fourth layer unit to a peak sensitivity in a region of the spectrum where the silver halide emulsions of the other three layer units are relatively insensitive, for instance at about 470 to 500 nm, the fourth layer unit can be exposed by light in this region of the spectrum to form a sound track. In one preferred form the fourth layer unit is spectrally sensitized to the infrared portion of the spectrum. The fourth layer unit can be coated in any convenient order with respect to the remaining layer units, but it is preferable to coat the fourth layer unit nearer the exposure light source than the remaining layer units, typically to overcoat the other three layer units, so that the best possible definition of the sound track image will be produced. Useful layer arrangements are disclosed in Japanese Publication No. 59838 and U.K. Pat. No. 1,424,454, cited above.

Still other variant forms of the photographic elements can be employed. For example, the emulsion of the sound track layer unit can be employed with only its native spectral sensitivity. In this instance the response of the sound track layer unit is confined to exposure to ultraviolet and the adjacent blue portion of the spectrum, the blue response varying to some extent with the silver halide chosen. In still another variant form the speed rather than the spectral response of the sound track recording layer unit can be different from that of another, image-forming layer unit. The sound track recording layer unit can be either faster or slower than an image-forming layer unit of similar spectral response. A combination of both differing spectral response and speed can also be employed to allow selective exposure of the sound track and image-forming layer units.

While any photographically useful amount of particles of the infrared absorbing dye-forming coupler and coupler solvent can be present in the layer units described above, for sound track applications employing S-1 photocells it is preferred that these particles be present in a concentration sufficient to provide a maximum dye density of at least 1.0 over the spectral region of from 750 to 850 nm, preferably at least 2. Such dye densities can be obtained readily with the preferred coupler-coupler solvent combinations within the concentration ranges conventionally employed for coupler solvent particles containing cyan, magenta and yellow dye-forming couplers. Generally coupler concentrations ranging from about 0.40 to 1.30 grams per square meter are contemplated, preferably from about 0.65 to 1.05 grams per square meter, optimally from about 0.75 to 0.95 gram per square meter.

The photographic silver halide emulsion layers, the adjacent hydrophilic colloid-containing layers in which the infrared absorbing dye-forming couplers can be incorporated and other layers, including overcoat, subbing and interlayer coatings of conventional character, can contain various colloids alone or in combination as vehicles. Suitable hydrophilic vehicle materials include both naturally-occurring substances such as proteins, for example, gelatin, gelatin derivatives, cellulose derivatives, polysaccharides such as dextran, gum arabic and the like; and synthetic polymeric substances such as water soluble polyvinyl compounds like poly(vinylpyrrolidone), acrylamide polymers and the like.

Photographic emulsion layers and other layers of photographic elements such as overcoat layers, interlayers and subbing layers, as well as receiving layers in image transfer elements can also contain alone or in combination with hydrophilic, water-permeable colloids, other synthetic polymeric vehicle compounds such as dispersed vinyl compounds such as in latex form and particularly those which increase the dimensional stability of the photographic materials. Typically synthetic polymers include those described in Nottorf U.S. Pat. No. 3,142,568 issued July 28, 1964; White U.S. Pat. No. 3,193,386 issued July 6, 1965; Houck et al. U.S. Pat. No. 3,062,674 issued Nov. 6, 1962; Houck et al. U.S. Pat. No. 3,220,844 issued Nov. 30, 1965; Ream et al. U.S. Pat. No. 3,287,289 issued Nov. 22, 1966; and Dykstra U.S. Pat. No. 3,411,911 issued Nov. 19, 1968. Other vehicle materials include those water-insoluble polymers of alkyl acrylates and methacrylates, acrylic acid, sulfoalkyl acrylates or methacrylates, those which have cross-linking sites which facilitate hardening or curing as described in Smith U.S. Pat. No. 3,488,708 issued Jan. 6, 1970, and those having recurring sulfobetaine units as described in Dykstra Canadian Pat. No. 774,054.

The vehicles and binders are typically coated from aqueous dispersions. The preferred hydrophilic colloids for coating purposes are gelatin and related derivatives. Gelatin and gelatin derivatives are typically coated in a concentration of from about 0.1 to 10 percent, preferably 2 to 6 percent, by weight, dry, based on total weight. The other hydrophilic colloids can be coated in similar concentration levels.

The silver halide photographic emulsions employed can be of any conventional, convenient form. For example, the silver halide emulsion types set forth in Paragraph I, *Product Licensing Index,* Vol. 92, December 1971, Item 9232, can be employed. The emulsions can be washed as described in Paragraph II, chemically sensitized, as described in Paragraph III and/or spectrally sensitized, as described in Paragraph XV. The emulsion and other hydrophilic colloid-containing layers of the photographic elements can contain development modifiers, as described in Paragraph IV, antifoggants and stabilizers, as described in Paragraph V, developing agents, as described in Paragraph VI, hardeners, as described in Paragraph VII, plasticizers and lubricants, as described in Paragraph XI, coating aids, as described in Paragraph XII, matting agents, as described in Paragraph XIII, brighteners, as described in Paragraph XIV, and absorbing and filter dyes, as described in Paragraph XVI. The various addenda can be incorporated by known methods of addition, as described in Paragraph XVII. The photographic elements can contain antistatic layers, as set forth in Paragraph IX. The color-forming materials, particularly the dye-forming couplers, can be chosen from those illustrated by Paragraph XXII. The dye-forming couplers which form the dye image to be viewed need not be coated in a coupler solvent, but can be coated in any conventional manner illustrated by the patents in Paragraph XVIII. As these patents further illustrate, interlayers can be provided between adjacent layer units containing compounds such as ballasted hydroquinones to prevent migration out of the layer unit of oxidized developing agent. Coating of the various materials can be undertaken employing procedures such as those described in Paragraph XVIII. *Product Licensing Index* is published by Industrial Opportunities Ltd., Homewell, Havant Hampshire, P09 1EF, UK.

The silver halide emulsion and remaining layers of the photographic elements can be coated on any conventional photographic support. For projection film applications including an integral sound track the support is specularly transmissive—e.g., transparent. For such applications conventional photographic film supports can be employed, such as cellulose nitrate film, cellulose acetate film, poly(vinyl acetal) film, polystyrene film, poly(ethylene terephthalate) film, polycarbonate film and similar resinous film supports.

In one preferred mode of exposure the photographic element is panchromatically exposed and an edge portion of the film is exposed to infrared radiation to form the sound track. When this mode of exposure is undertaken, the silver halide grains in the sound track recording layer unit are spectrally sensitized with infrared absorbing spectral sensitizing dyes. Typical useful infrared spectral sensitizing dyes are described, for example, in Trivelli et al. U.S. Pat. No. 2,245,236, issued June 10, 1941; Brooker U.S. Pat. Nos. 2,095,854 and 2,095,856 issued Oct. 12, 1937; Dieterle U.S. Pat. No. 2,084,436, issued June 22, 1937; Zeh U.S. Pat. No. 2,104,064, issued Jan. 4, 1938; Konig U.S. Pat. No. 2,199,542, issued May 7, 1940; Brooker et al U.S. Pat. No. 2,213,238, issued Sept. 3, 1940; Heseltine U.S. Pat. Nos. 2,734,900 and 3,582,344, issued Feb. 14, 1956 and June 1, 1971, respectively; Barth et al U.S. Pat. No. 2,134,546, issued Oct. 25, 1938; Brooker U.S. Pat. No. 2,186,624, issued Jan. 9, 1940; Schneider U.S. Pat. No. 2,073,759, issued Mar. 16, 1937; Thompson U.S. Pat. No. 2,611,695, issued Sept. 23, 1952; Brooker et al U.S. Pat. No. 2,955,939, issued Oct. 11, 1960; Jenkins et al. U.S. Pat. No. 3,573,921, issued Apr. 6, 1971; Jeffreys U.S. Pat. No. 3,552,974, issued Jan. 5, 1971; and Fumia et al U.S. Pat. Nos. 3,482,978, 3,623,881 and 3,652,288, issued Dec. 9, 1969, Nov. 30, 1971 and Mar. 29, 1972, respectively.

The photographic elements can be processed to form dye images which correspond to or are reversals of the silver halide rendered selectively developable by imagewise exposure by conventional techniques. Multicolor reversal dye images can be formed in photographic elements having differentially spectrally sensitized silver halide layers by black-and-white development followed by a single color development step, as illustrated by the Kodak Ektachrome E4 and E6 and Agfa processes described in *British Journal of Photography Annual,* 1977, pp. 194–197, and *British Journal of Photography,* pp. 668–669. The photographic elements can be adapted for direct color reversal processing (i.e., production of reversal color images without prior black-and-white development), as illustrated by Barr U.S. Pat. No. 3,243,294; Hendess et al U.S. Pat. No. 3,647,452; Puschel et al U.S. Pat. Nos. 3,457,077 and 3,467,520 and German OLS No. 1,257,570; Accary-Venet U.K. Pat. No. 1,132,736; Schranz et al German OLS No. 1,259,700; Marx et al German OLS No. 1,259,701; Muller-Bore German OLS No. 2,005,091 and U.K. Pat. No. 1,075,385.

Multicolor dye images which correspond to the silver halide rendered selectively developable by imagewise exposure, typically negative dye images, can be produced by processing, as illustrated by the Kodacolor C-22, the Kodak Flexicolor C-41 and the Agfa color processes described in *British Journal of Photography Annual,* 1977, pp. 201–205. The photographic elements can also be processed by the Kodak Ektaprint-3 and -300 processes as described in Kodak Color Dataguide, 5th Ed., 1975, pp. 18–19, and the Agfa color process as described in *British Journal of Photography Annual,* 1977, pp. 205–206.

The photographic elements can be processed in the presence of reducible species, such as transition metal ion complexes (e.g. cobalt(III) and ruthenium(III) complexes containing amine and/or ammine ligands) and peroxy compounds (e.g. hydrogen peroxide and alkali metal perborates and percarbonates).

Dye images can be formed or amplified by processes which employ in combination with a dye-image-generating reducing agent an inert transition metal ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent, as illustrated by Matejec U.S. Pat. No. 3,674,490, *Research Disclosure,* Vol. 116, December 1973, Item 11660, and Bissonette, *Research Disclosure,* Vol. 148, August 1976, Items 14836, 14846 and 14847. The photographic elements can be particularly adapted to form dye images by such processes, as illustrated by Dunn et al U.S. Pat. No. 3,822,129; Bissonette U.S. Pat. Nos. 3,834,907, 3,847,619 and 3,902,905 and Mowrey U.S. Pat. No. 3,904,413.

In a specific preferred application the photographic elements of this invention are employed to form a motion picture film for projection containing an integral sound track useful in a projector having an S-1 photocell. The photographic element is comprised of a transparent film support on which are coated, in the order recited, a red-sensitized cyan dye-forming coupler containing first layer unit, a green-sensitized magenta dye-forming coupler containing a second layer unit, a blue-sensitive yellow dye-forming coupler containing third layer unit and an infrared-sensitized fourth layer unit containing coupler solvent particles according to this invention, as has been described above. The picture recording portion of the element is flashed to infrared and is then exposed to the blue, green and red portions of the spectrum through a master image film. The master image film has a transparent support and has been processed so that it carries a positive multicolor dye image. The edge of the photographic element on which the integral sound track is to be formed is panchromatically exposed through a positive sound track master by a light source to which at least the fourth layer unit is sensitive. In a preferred form this is a white light source which exposes the red-sensitized, green-sensitized and blue-sensitive layer units. The fourth layer unit by reason of its native sensitivity to blue light is also exposed by the white light source. The white light source can also emit infrared to expose the fourth layer unit. The photographic element after exposure of both the picture and sound track areas is reversal processed. In reversal processing of negative-working silver halide emulsions, positive dye images are formed in unexposed areas. Since the picture area was uniformly flashed to infrared, no density attributable to the fourth layer unit is present in the picture area. In the sound track area the major portion of the infrared density is attributable to the fourth layer unit, but the other layer units can also add to the total infrared density.

In another specific application which further illustrates the diversity of uses contemplated, a motion picture projection film containing an integral sound track can also be obtained using a fourth layer unit which is spectrally sensitized to the region of 470 to 500 nm. The element can be exposed in picture recording areas through a multicolor negative master image film with red, green and blue (420 to 470 nm) light. The film sound track area can be exposed through a negative master sound track using a light source emitting in at least the 470 to 500 nm region of the spectrum. Using negative-working silver halide emulsion in the layer units, development produces in picture and sound track areas of the element positive dye images. The sound track image is formed primarily by the fourth layer unit.

In processing to form dye images in the manner described above any conventional color developing agent can be employed which will permit the formation of a microcrystalline dye. Depending upon the specific color developing agent selected, the maximum dye densities, the wavelength of the peak densities and the increased breadth of bathochromic absorption will vary. The color developing agent 4-amino-3-methyl-N-$\beta$-(methanesulfonamide)ethylaniline sulfate hydrate has been observed to produce microcrystalline infrared absorbing dye images having a maximum density in excess of 1.0, often in excess in of 2.0, not only at 800 nm, but over the entire spectral region of from about 750 to 850 nm. Such microcrystalline infrared absorbing dye images are ideally suited to forming dye sound tracks for use in motion picture projection film equipment employing S-1 and similar photocells intended to respond to silver sound tracks. In the photographic elements of this invention can be produced infrared absorbing dye sound tracks which are comparable in fidelity with the silver sound tracks they are intended to replace, although a somewhat higher gain may be required for comparable decibel output, since the dye sound track is of somewhat lower maximum density than are silver sound tracks.

As employed herein, the term "microcrystalline dye" refers to a dye which is present in a crystalline physical form, but the size of the dye crystals are too small to be visually detected with the unaided eye. Such crystals can sometimes be seen upon microscopic examination, but in many instances the crystals are of submicroscopic sizes. Since each dye is a reaction product of a coupler and an oxidized color developing agent in a coupler solvent particle, it follows that the steric configuration of the coupler, the developing agent and the coupler solvent as well as their relative proportions all influence the crystallinity of the dye produced. The choice of the coupler is generally most important to forming photographic elements which can form microcrystalline dyes. The formation of mixed phases of microcrystalline and noncrystalline dyes is specifically contemplated and is in many instances preferred to permit the formation of broadened absorption peaks. It is believed that the broadening of the absorption peak is the product of two unresolved or fused absorption peaks—one attributable to the microcrystalline dye produced and the other attributable to the noncrystalline dye produced. Although at least a portion of the dye produced is microcrystalline, it should be noted that the couplers are not themselves crystalline, since crystallinity in couplers produces significant loss of dye density attributable to lack of availability of the coupler as well as severe problems in dispersing and coating the crystalline coupler.

Crystallinity, particularly submicroscopic microcrystallinity, can be ascertained by a number of known general analytical techniques as well as by some techniques which are peculiar to the photographic arts. In photography microcrystalline dyes are commonly associated with shifts in hue as a function of concentration and by asymmetrical absorption peaks. Both hyposchromic and bathochromic shifts attributable to microcrystallinity have been observed in varied conventional dye structures. Microcrystalline dyes have, for example, found applications in photographic elements because of their sharp transition between high peak and low toe densities, as illustrated by S. J. Ciurca, *Research Disclosure,*

Vol. 157, May 1977, Item 15730. Analytical techniques, such as X-ray diffraction and detection of birefringence, can also be employed to identify crystalline structure. Such analytical techniques are described by A. Weissberger and B. W. Rossiter, *Techniques of Chemistry, Physical Methods of Chemistry,* Vol. 1, p. 3A-D, Wiley, 1972.

EXAMPLES

The practice of this invention can be better appreciated by reference to the following examples:

EXAMPLES 1-4

A. A sample of m-[N-δ-(2',4'-di-t-amylphenoxy)-butylsulfamoyl]-1-hydroxy-2-naphthanilide, hereinafter designated Coupler 1, was prepared in the following manner:

First, N-[δ-(2',4'-di-t-amylphenoxy)butyl]-m-nitrobenzene sulfonamide, hereinafter designated Nitro Compound I was prepared in the following manner:

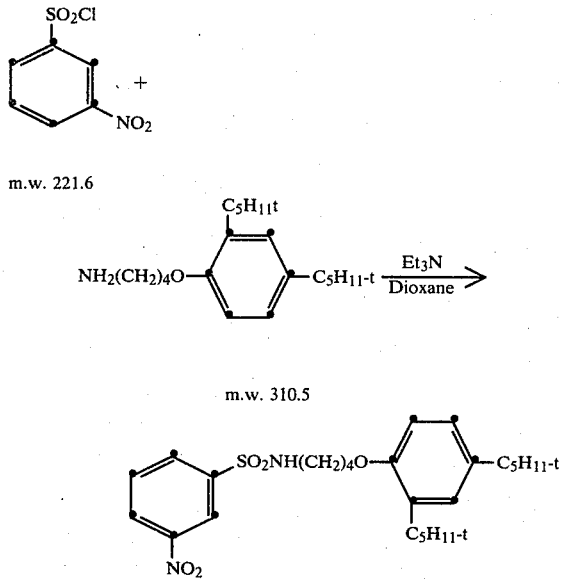

To a stirred solution of 76.5 g (0.345 mole) of m-nitrobenzenesulfonyl chloride in 300 ml of dioxane was added a solution of triethylamine 39.3 g (0.39 mole) and 91.5 g (0.295 mole) of δ-(2,4-di-t-amylphenoxy)butylamine in 600 ml of dioxane at a rate so that the temperature did not exceed 45° C. Total stirring time was 1 hour. To the reaction mixture was added 5 liters of water containing ice and 100 ml of concentrated hydrochloric acid. After the mixture was allowed to settle, the aqueous phase was decanted from the residual oil which has then triturated with water and ice. Upon standing, the residual oil solidified. The solid was dissolved in 500 ml of 1:1 ethanol/benzene and the solution was evaporated under reduced pressure to give an oil that was free of water. The reddish-brown oil upon trituration with hexane yielded a fine off-white precipitate which was collected by suction filtration, washed on the funnel with hexane and air dried to give 100 g (69%) of solid material which melts at approximately 81° C. TLC analysis indicated essentially pure component material.

Nitro Compound I was then employed to prepare Coupler 1 in the following manner:

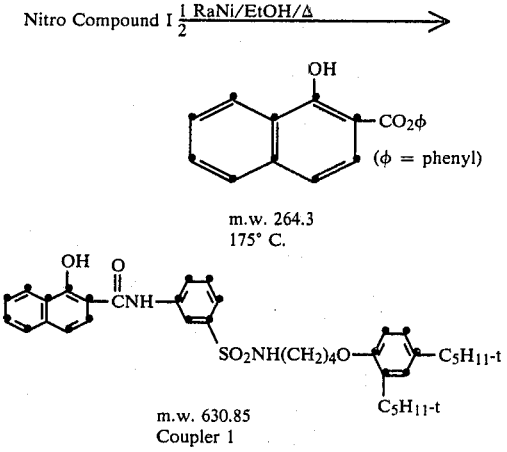

Seventy-five grams (0.151 mole) of the Nitro Compound I was dissolved in 900 ml of absolute ethanol with heating on the steam bath. About 6 grams of Raney nickel were added to the cool mixture and it was shaken under 207 kPa of hydrogen for five hours at approximately 50° C. Only about 20% of the theoretical hydrogen was taken up. To the hydrogenation mixture, additional Raney nickel catalyst was then added and the mixture was again shaken under 255 kPa of hydrogen pressure at approximately 40° C. for an additional 4½ hours at which point theoretical hydrogen had been consumed. TLC analysis of the reaction mixture indicated that all of the nitro compound had been reduced. The catalyst was filtered off giving an almost colorless liquid which when evaporated under reduced pressure gave a light oil. The amine obtained from the reduction was mixed with 44 g (0.166 mole) of phenyl-1-hydroxy-2-naphthoate and heated in an oil bath at 150°-170° C. with stirring for approximately two hours. Upon cooling, a solid was obtained which was dissolved in 600 ml of boiling ethylacetate, treated with 2 teaspoons of decolorizing carbon powder and filtered. To the filtrate was added 3 times the volume of ligroin which resulted in an off-white precipitate which was collected and washed with cold ligroin. The air-dried solid was dissolved in about 800 ml of benzene at the boil and allowed to cool slowly at room temperature. An almost white solid was obtained which was collected, pressed out and washed with cold benzene and then washed well with ligroin. The material when dried weighed 53 g (56% yield), and had m.p. 173°-174° C. Elemental analysis for carbon, hydrogen, nitrogen and sulfur were in agreement with the theoretical values for this compound.

B. A sample of m-{N-[β-(2,4-di-t-amylphenoxy)-butyl]sulfamoyl}-1-hydroxy-2-naphthanilide, hereinafter designated Coupler 2, was prepared in the following manner:

First, N-[β-(2',4'-di-t-amylphenoxy)butyl]-m-nitrobenzenesulfonamide, hereinafter designated Nitro Compound II, was prepared in the following manner:

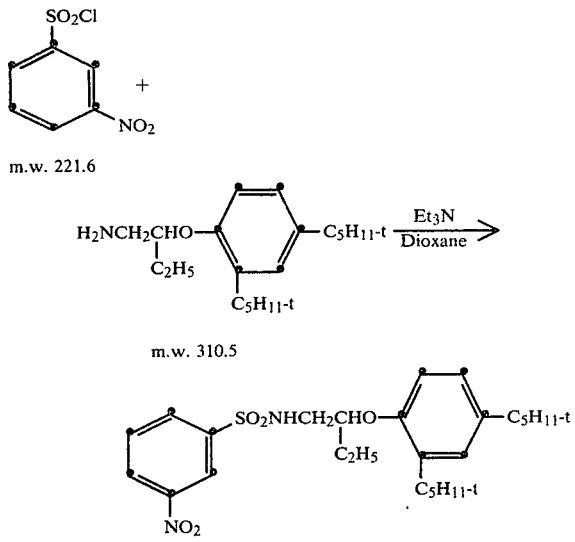

To a stirred solution of 30.5 g (0.0985 mole) of 2,4-di-t-pentylphenoxybutylamine and 13.1 g (0.13 mole) of triethylamine dissolved in 200 ml of dioxane was added a solution of 25.5 g (0.12 mole) m-nitrobenzenesulfonyl chloride at a rate such that the temperature did not exceed 40° C. The reaction mixture was stirred for 1 hour and then drowned in 1½ liters ice and water containing 25 ml concentrated hydrochloric acid. The mixture was allowed to settle and the aqueous phase was decanted and the residual oil was triturated two times with water-ice mixtures. The residual oil was air dried and used directly in the next step.

Nitro Compound II was then employed to prepare Coupler 2 in the following manner:

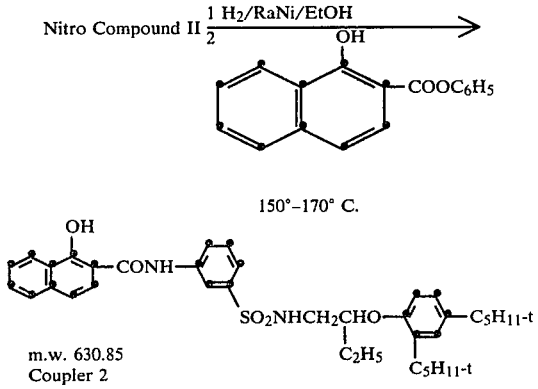

The crude oil containing Nitro Compound II from the previous step was dissolved in 300 ml of ethanol, Raney nickel was added and the mixture was shaken under 276 kPa of hydrogen. After the theoretical amount of hydrogen was taken up, the mixture was filtered with the aid of fiber-glass discs and the filtrate was evaporated under reduced pressure to give a residual oil. This oil was then mixed with phenyl-1-hydroxy-2-naphthoate and heated neat from 150° to 170° C. for 45 minutes. When cool, the reaction mixture was triturated with 800 ml of hexane giving a solid which was collected, washed with hexane, and air dried, yield 38.8 g (64%). The crude material (10 g) was slurried with 300 ml of 2:1 in benzene ethyl acetate and filtered through 100 g of silica gel. The elution was completed with 300 ml of 2:1 benzene:ethyl acetate. The combined filtrates were evaporated under reduced pressure and the residue was dissolved in 40 ml of ethyl acetate, filtered and drowned with 300 ml of hexane. The solution was cooled, nucleated by scratching the glass container and allowed to stand overnight. The resulting solid was collected, yield 6.8 g (68% recovery), m.p. 152°-154° C. Elemental analysis for carbon, hydrogen and nitrogen were in agreement with the structure. Analysis by thin layer chromatography indicated that a small amount of nonmigrating residue was taken out of the crude material by filtration through silica gel.

C. A sample of di-[m-(N-n-octyl)sulfamoyl]-1-hydroxy-2-naphthanilide, hereinafter designated Coupler 3, was prepared in the following manner:

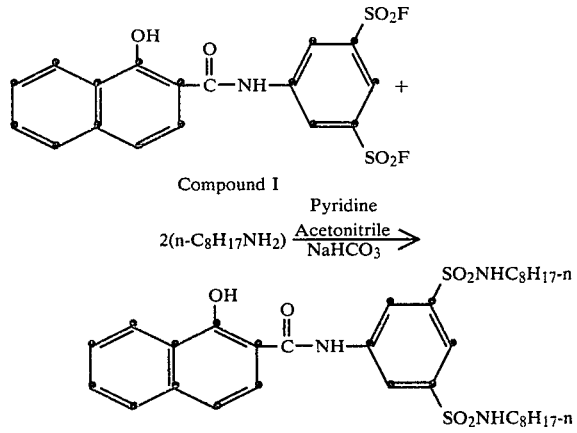

A slurry was prepared of 8.6 g (0.02 mole) of Compound I in about 50 ml of dry acetonitrile. To this was added 7.8 g (0.06 mole) of the amine, 6.6 g (0.08 mole) $NaHCO_3$, 8 ml dry pyridine, and about 50 ml dye acetonitrile. The resulting mixture was refluxed with stirring for 2 hours. The hot reaction mixture was then filtered, cooled in ice, and allowed to stand at room temperature. The resulting percipitate was collected, washed with cold acetonitrile, and air dried to yield 6.3 g of crystalline solid. The collected solids were then dissolved in 150 ml acetonitrile, filtered while hot, heated to redissolve any precipitate, and poured in about 600 ml water containing 10 ml hydrochloric acid. The resulting precipitate was collected, washed with water and dried to yield 5.2 g, m.p. 196°-197.5° C.

D. A sample of di-[m-(N-n-dodecyl)sulfamoyl]-1-hydroxy-2-naphthanilide, hereinafter designated Coupler 4, was prepared similarly as Coupler 3, except that n-dodecylamine was used instead of n-octylamine.

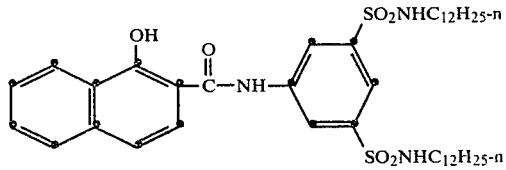

Coupler 4

E. A sample of 3-ethylsulfamoyl-4l-trifluoroacetamidoaniline, hereinafter designated as Amine Compound I, was prepared in the following manner:

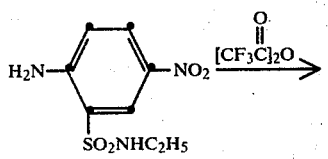

Compound II

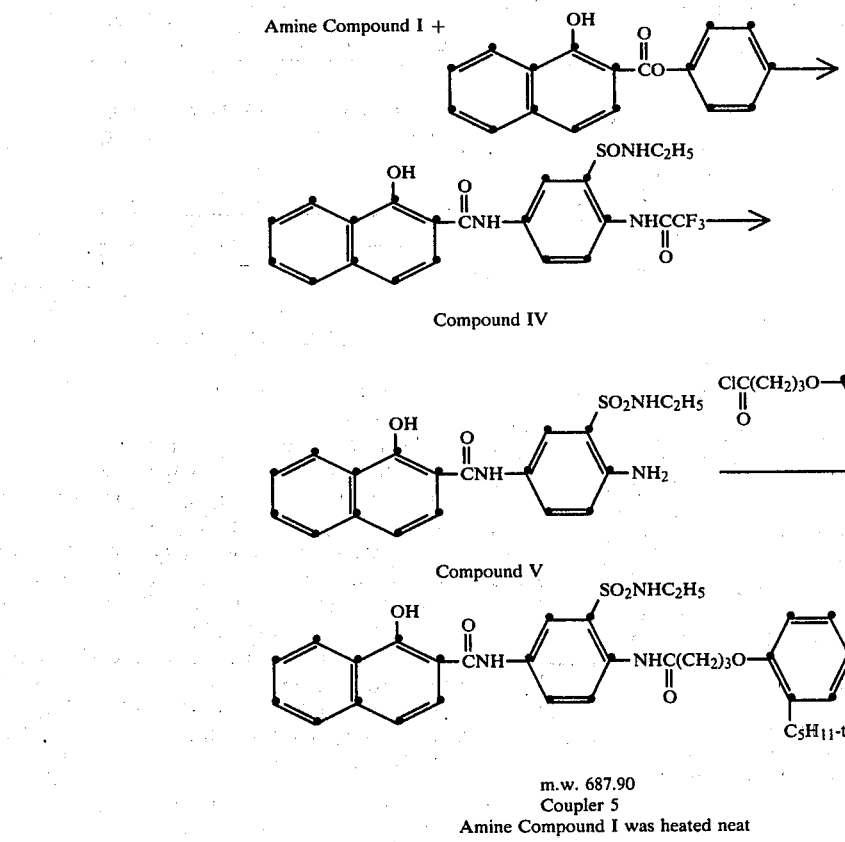

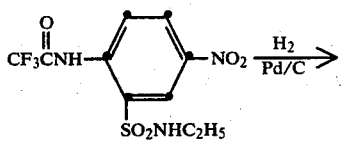

Compound III

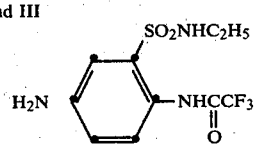

Amine Compound I

To 50 g (approx. 0.2 mole) of Compound II dissolved in 400 ml of tetrahydrofuran was added 50 g (0.2+ mole) of trifluoroacetic anhydride. The mixture was stirred at room temperature for about 3 hours. At this point thin-layer chromatography indicated little or no starting material left. Mixture was concentrated to dryness and recrystallized immediately from methanol to yield about 37.4 g whte crystalline solid Compound III, m.p. 164°-166° C.

Thirty-two grams of Compound III was dissolved in 250 ml of tetrahydrofuran. A palladium-carbon catalyst was then added and the resulting mixture was hydrogenated on a Parr Apparatus overnight. The catalyst was filtered off, and the filtrate was concentrated to dryness to yield a white solid residue.

Amine Compound I was then employed to prepare Coupler 5 in the following manner:

During the last hour an aspirator vacuum was applied to facilitate removal of phenol. A little acetonitrile was added to the residue and stirred. The solids were collected, placed in acetonitrile, stirred and recollected to yield 27.4 g Compound IV, m.p. 255°-257° C.

To a solution of 20 g (0.2 mole) sodium carbonate in 200 ml water was added approx. 24 g (0.05 mole) of Compound IV. To this was added about 75 ml dimethylformamide and the solution was then stirred at room temperature overnight. The solution then stood at room temperature for 24 hours and precipitation occurred. The solids were collected on a Buchner funnel, washing with water. The moist solids were transferred to a 500 ml Erlenmeyer flask and water was added to the top. This was stirred magnetically for a few minutes and then the solids were collected, washed with water and dried in a vacuum oven to yield 11.5 g of Compound V, m.p. 225°-227° C.

To 12 g (0.03 mole) of Compound V in 250 ml dry tetrahydrofuran was added 0.03 mole N,N-dimethylaniline. While stirring, to this mixture was slowly added 0.03 mole of 4-(2,4-di-t-pentylphenoxy)butyryl chloride dissolved in 100 ml tetahydrofuran. The resulting solution was stirred at room temperature overnight and then concentrated to dryness. A viscous residue remained. Acetonitrile was added and stirred magnetically. Within a few minutes a white solid precipitated. The solids were collected, washed with acetonitrile and recrystallized from acetonitrile to yield 14.1 g Coupler 5, m.p. 180°-181° C.

F. For purposes of comparison a sample of the following coupler, hereinafter designed Control Coupler 1, was employed:

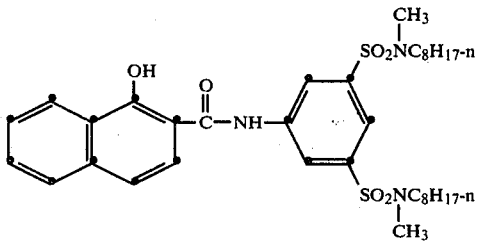

Control Coupler 1

EXAMPLE 5

A. A photographic element having a transparent film support and a gelatino-silver halide emulsion layer and a clear gelatin overcoat layer coated thereon was prepared. The emulsion coating contained the ingredients set forth below in Table I. Unless otherwise stated, all coating coverages in the examples are reported parenthetically in terms of grams per square meter. Silver halide coverages are reported in terms of silver.

TABLE I

| Photographic Element 5-A |
|---|
| Gelatino-Silver Halide Emulsion Layer: Silver Bromoiodide (0.91); Gelatin (3.78); Coupler 2, $1.6 \times 10^{-3}$ mole/m$^2$; Coupler Solvent Di-n-butyl phthalate, weight ratio coupler to coupler solvent 1:0.5 |
| Transparent Film Support |

The coupler was dispersed in the coupler solvent which was in turn dispersed in particulate form in the gelatin of the silver halide emulsion.

B. A sample of the photographic element was exposed for 2 seconds at a color temperature of 3000° K. with an Eastman 1B sensitometer through a graduated density test object. The test object had 21 equal density steps from 0 density at Step 1 to a density of 6.0 at Step 21.

C. The exposed sample of the photographic element was then processed at 40° C. in the following manner:

The sample was developed for 2 minutes in the color developer set forth in Table II.

TABLE II

| Color Developer | |
|---|---|
| 2.0 g | Potassium sulfite |
| 5.0 g | 4-Amino-3-methyl-N-ethyl-N-(methanesulfonamido)ethylaniline sulfate hydrate |
| 30 g | Potassium carbonate (anhydrous) |
| 1.25 g | Potassium bromide |

TABLE II-continued

| Color Developer | |
|---|---|
| 0.0006 g | Potassium iodide |
| Water to 1 liter, pH 11.0 | |

The sample was washed in water for 2 minutes and immersed for 2 minutes in a bleach bath of the composition set forth in Table III.

TABLE III

| Bleach Bath | |
|---|---|
| 21.5 g | Sodium bromide |
| 100.0 g | Potassium ferricyanide |
| 0.07 g | $NaH_2PO_4 \cdot H_2O$ |
| Water to 1 liter, pH 7.0 | |

The sample was washed in water for 2 minutes and immersed for 2 minutes in a fix bath of the composition set forth in Table IV.

TABLE IV

| Fix bath | |
|---|---|
| 250.0 g | $Na_2S_2O_3 \cdot 10H_2O$ |
| 1.5 g | Sodium bisulfite |
| 6.0 g | Sodium sulfite |
| Water to 1 liter, pH 7.0 | |

The sample was washed in water for 2 minutes and allowed to dry at room temperature.

D. In FIG. 1 a plot of density versus wavelength is shown. The reference numerals applied to the curves refer to the step number of the step tablet through which that portion of the sample was exposed. It can be seen where low maximum dye densities were produced the absorption peak produced by the dye was in the vicinity of about 740 nm. In Curves 11 and 9 and lower numbered curves, not shown, broadening of the absorption peak and shifting the peak to well above 800 nm is in evidence. In Curves 11, 9 and lower numbered curves, not shown, a maximum dye density in excess of 1 was obtained throughout the spectral region of from about 750 to 850 nm.

EXAMPLE 6

Figure 2:
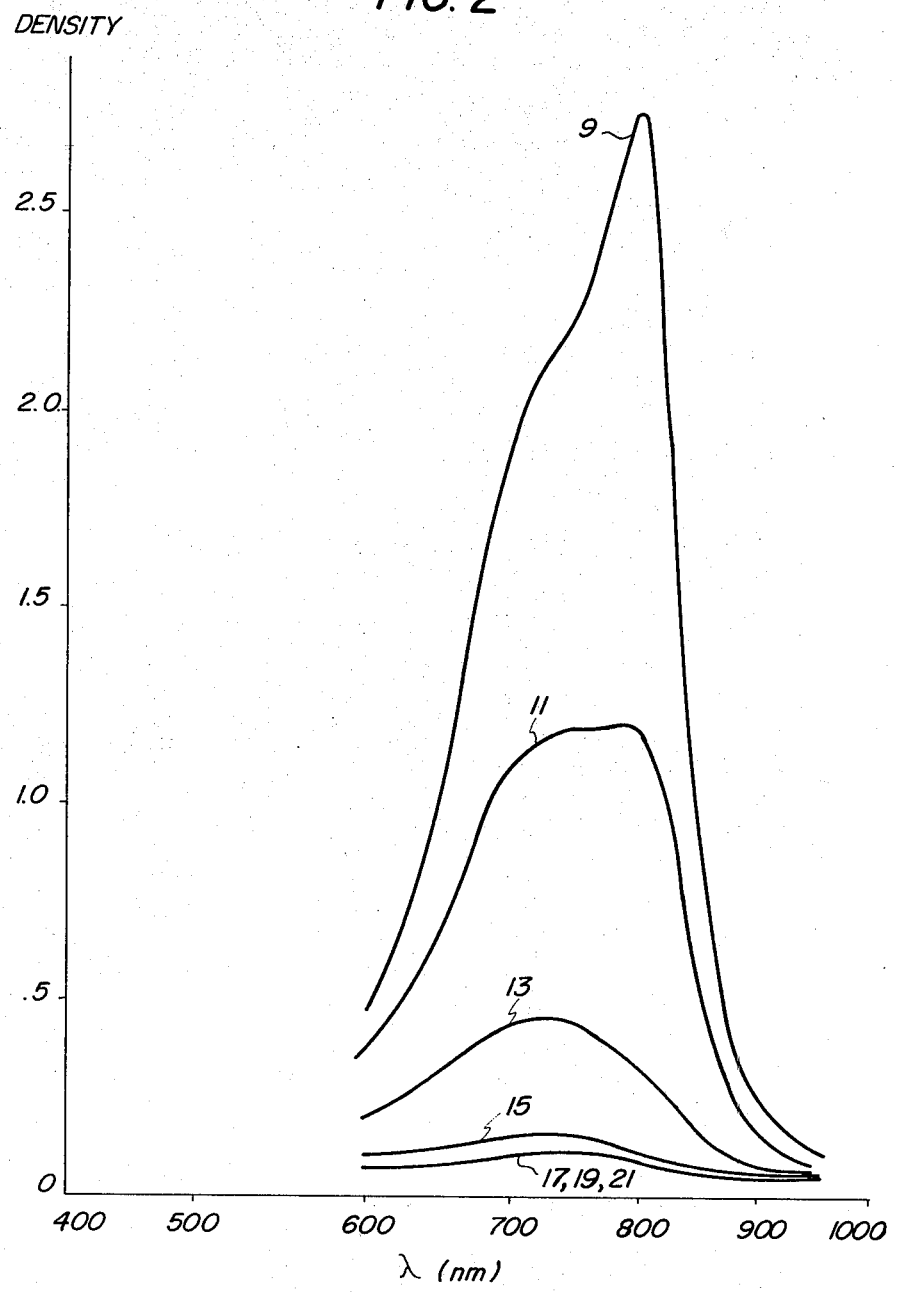

Example 5 was repeated, but with the substitution of Coupler 3 for Coupler 2 and adjustment of coupler to coupler solvent weight ratio to 1:2. Similar results were obtained as in Example 5, as illustrated in FIG. 2.

EXAMPLE 7

Figure 3:
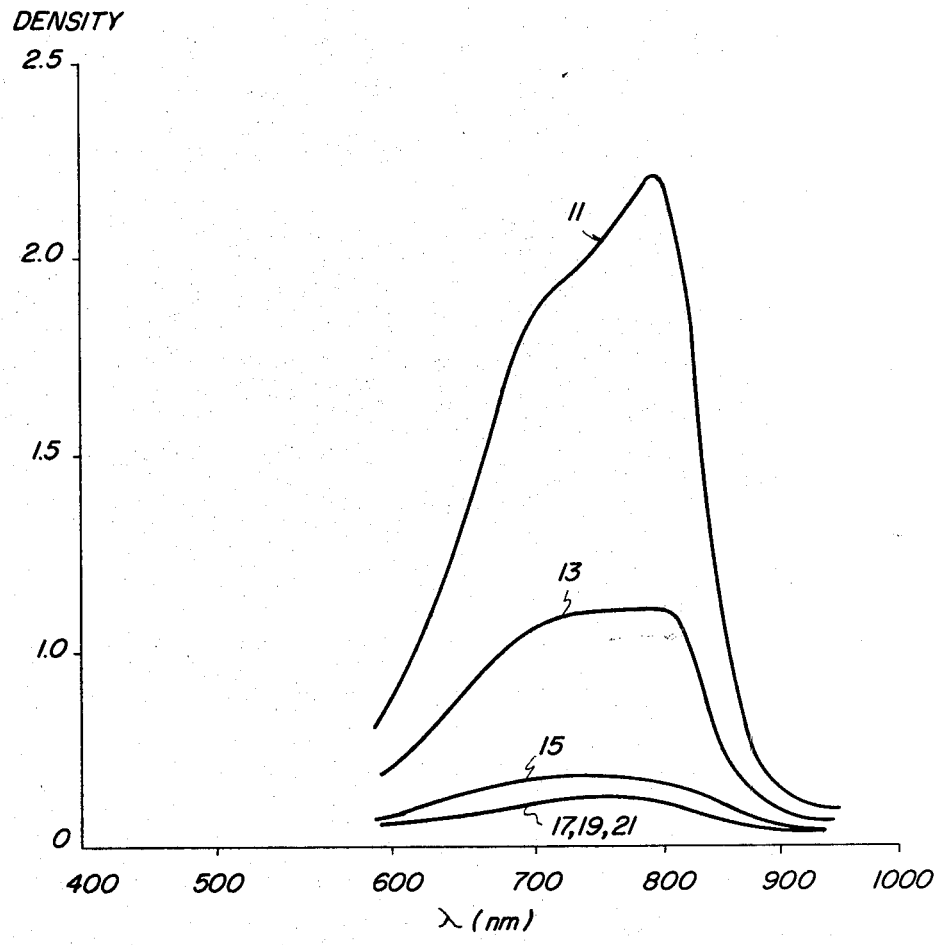

Example 5 was repeated, but with the substitution of Coupler 4 for Coupler 2 and adjustment of coupler to coupler solvent weight ratio to 1:2. Similar results were obtained as in Example 5, as illustrated in FIG. 3.

EXAMPLE 8

Figure 4:
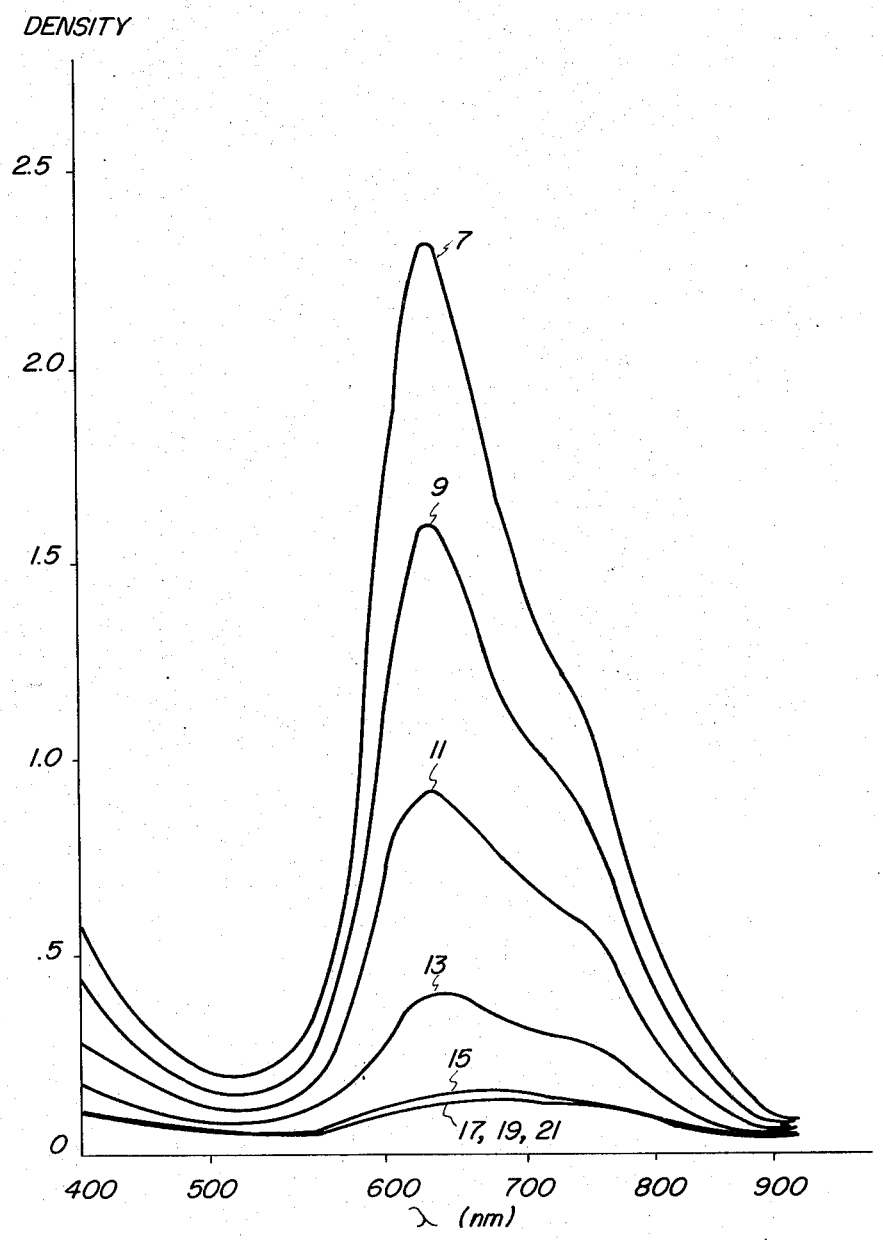

Example 5 was repeated, but with the substitution of Coupler 5 for Coupler 2 and adjustment of coupler to coupler solvent weight ratio to 1:1. The primary absorption peak obtained remained in all instances between 600 and 700 nm, as illustrated in FIG. 4. Bathochromic broadening of the absorption was noted, and in lower numbered curves, not shown, absorption exceeded a density of 1 throughout the range of from 750 to 850 nm.

EXAMPLE 9 (Comparative example)

Figure 5:
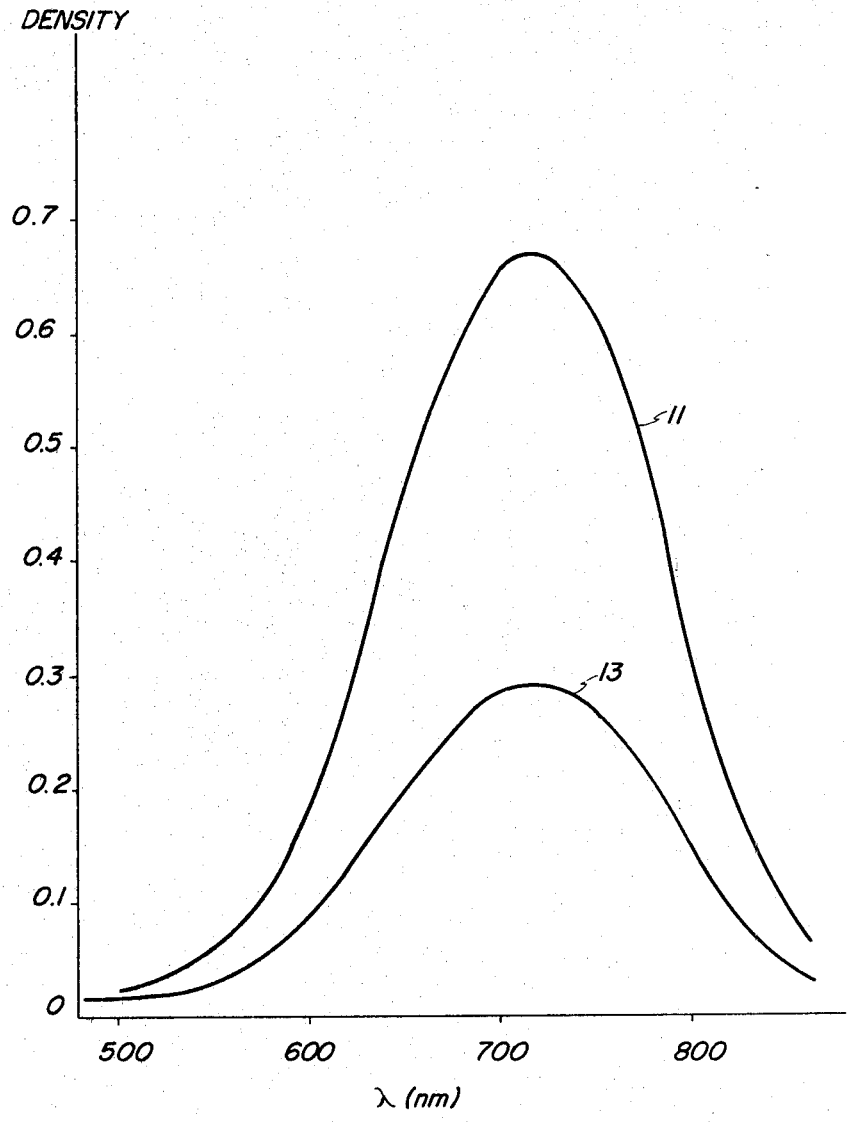

Example 5 was repeated but with the substitution of Control Coupler 1 for Coupler 2 and adjustment of coupler to coupler solvent weight ratio to 1:2. The absorption peak obtained remained in all instances between 700 and 740 nm, as illustrated in FIG. 5. The maximum density levels were in all curves unacceptably low over the range of from 750 to 850 nm.

EXAMPLE 10

A. Eight separate photographic elements were prepared having the general structure shown below in Table V. The coupler solvent and its concentration is separately listed in Table VI.

TABLE V

| Photographic Elements 10A-H |
|---|
| Gelatino-Silver Halide Emulsion Layer: 0.2 micron Infrared-Sensitized Silver Bromoiodide (0.78); Coupler 1 (0.86); Coupler Solvent (See Table VI); Gelatin (2.45) |
| Film Support |

TABLE VI

| Element | Coupler Solvent (CS) | Coupler:CS | CS Coverage |
|---|---|---|---|
| 10A | Tri-o-cresyl phosphate | 1:2 | 1.72 |
| 10B | Di-n-butyl phthalate | 1:2 | 1.72 |
| 10C | N,N-Diethyl lauramide | 1:2 | 1.72 |
| 10D | Tri-o-cresyl phosphate | 1:1 | 0.86 |
| 10E | Di-n-butyl phthalate | 1:1 | 0.86 |
| 10F | N,N-Diethyl lauramide | 1:1 | 0.86 |
| 10G | Tri-o-cresyl phosphate | 2:1 | 0.43 |
| 10H | N,N-Diethyl lauramide | 2:1 | 0.43 |

B. A sample of each photographic element was exposed for 1 second at a color temperature of 2854° K. with an Eastman 1B sensitometer through a graduated density step object. The test object had 21 equal density steps from 0 density at Step 1 to a density of 6.0 at Step 21.

C. The exposed samples of the photographic elements were then processed at 38° C. in the following manner:

Each sample was immersed for 2 minutes in a prehardener bath of the composition set forth in Table VII.

TABLE VII

| Prehardener Bath | |
|---|---|
| 800 ml | Water |
| 0.5 g | p-Toluenesulfinic acid sodium salt |
| 2.7 ml | 95% Sulfuric acid |
| 4.3 ml | 2,5-Dimethoxy-tetrahydrofuran |
| 154 g | Sodium sulfate |
| 2.0 g | Sodium bromide |
| 20 g | Sodium acetate |
| 27.0 ml | 27% Formaldehyde solution |
| 0.5 ml | 40% Sodium hydroxide solution |
| 3.0 ml | 1% N-methyl-benzothiazolium-p-toluenesulfonate |
| Water to 1 liter | |

Each sample was immersed in a neutralizer bath of the composition set forth in Table VIII for 30 seconds.

TABLE VIII

| Neutralizer Bath | |
|---|---|
| 800 ml | Water |
| 22.0 g | Hydroxylamine sulfate |

TABLE VIII-continued

| Neutralizer Bath | |
|---|---|
| 17.0 g | Sodium bromide |
| 50.0 g | Sodium sulfate |
| 10.0 ml | Glacial acetic acid |
| 5.7 g | Sodium hydroxide |
| Water to 1 liter | |

Each sample was immersed for 2 minutes in a black-and-white developer solution of the composition set forth below in Table IX.

TABLE IX

| Black-and-White Developer | |
|---|---|
| 800 ml | Water |
| 2.0 g | Sodium hexametaphosphate |
| 8.0 g | Sodium bisulfite |
| 47 g | Sodium sulfite |
| 33 g | Sodium carbonate |
| 5.5 g | Hydroquinone |
| 0.35 g | 1-Phenyl-3-pyrazolidone |
| 1.3 g | Sodium bromide |
| 1.38 g | Sodium thiocyanate |
| 0.013 g | Potassium iodide |
| 1.1 g | Sodium hydroxide |
| Water to 1 liter | |

Each sample was immersed for 1 minute in a stop bath of the composition set forth below in Table X.

TABLE X

| Stop Bath | |
|---|---|
| 800 ml | Water |
| 30 ml | Glacial acetic acid |
| 5.35 g | Sodium hydroxide |
| Water to 1 liter | |

Each sample was washed for 30 seconds in water and then immersed for 8 minutes in color developer of the composition set forth in Table XI.

TABLE XI

| Color Developer | |
|---|---|
| 800 ml | Water |
| 5.0 g | Sodium hexametaphosphate |
| 4.5 ml | Benzyl alcohol |
| 7.5 g | Sodium sulfite |
| 36 g | Trisodium phosphate |
| 0.9 g | Sodium bromide |
| 0.090 g | Potassium iodide |
| 5.2 ml | 40% Sodium hydroxide |
| 1.5 g | Citrazinic acid |
| 11.0 g | 4-Amino-3-methyl-N-ethyl-N-β-(methanesulfonamido)ethylaniline sulfate hydrate (CD-3) |
| 3.4 ml | 98% Ethylene diamine |
| 5.4 ml | 1.4% t-Butylamine borane |
| Water to 1 liter | |

Each sample was immersed in the stop bath again for 2 minutes, washed in water for 1 minute and immersed for 4 minutes in a bleach bath of the composition set forth in Table XII.

TABLE XII

| Bleach Bath | |
|---|---|
| 800 ml | Water |
| 1.0 g | Sodium hexametaphosphate |
| 144 g | Potassium ferricyanide |
| 34.4 g | Sodium bromide |
| 120 g | Sodium sulfate |
| 3 ml | 50% Polyethyleneoxide (m.w. ≅1540) solution |
| 0.05 g | Sodium hydroxide |

TABLE XII-continued

| Bleach Bath |
|---|
| Water to 1 liter |

Each sample was briefly rinsed in water and immersed for 4 minutes in a fix bath of the composition set forth in Table XIII.

TABLE XIII

| Fix Bath | | |
|---|---|---|
| 800 | ml | Water |
| 3.9 | g | Sodium sulfite |
| 6.3 | g | Sodium bisulfite |
| 169 | ml | Ammonium thiosulfate |
| Water to 1 liter | | |

Each sample was washed in water for 2 minutes and then immersed for 30 seconds in a stabilizer solution containing 7 ml of 27% formaldehyde solution in 1 liter of water. Each sample was then allowed to dry.

Figure 6:
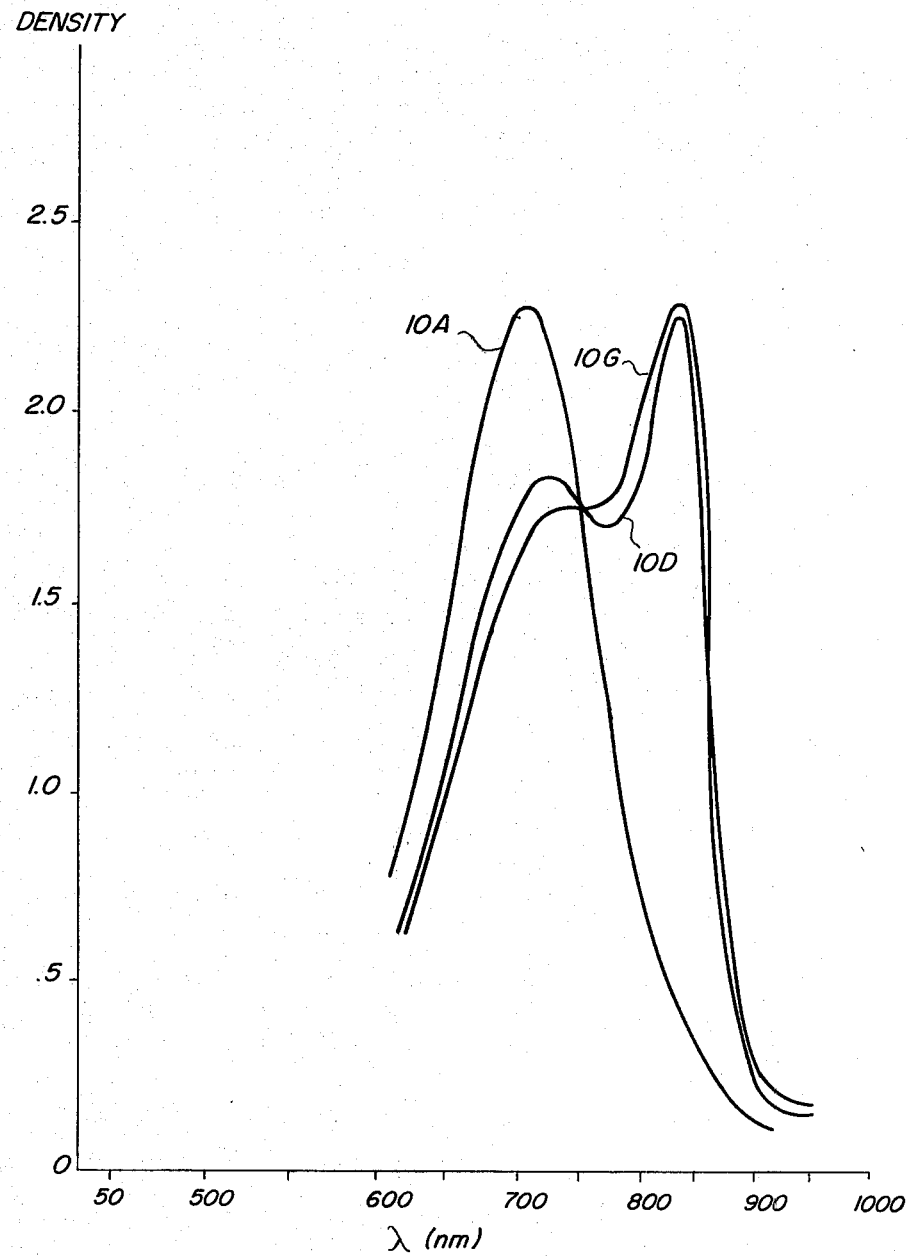
Figure 7:
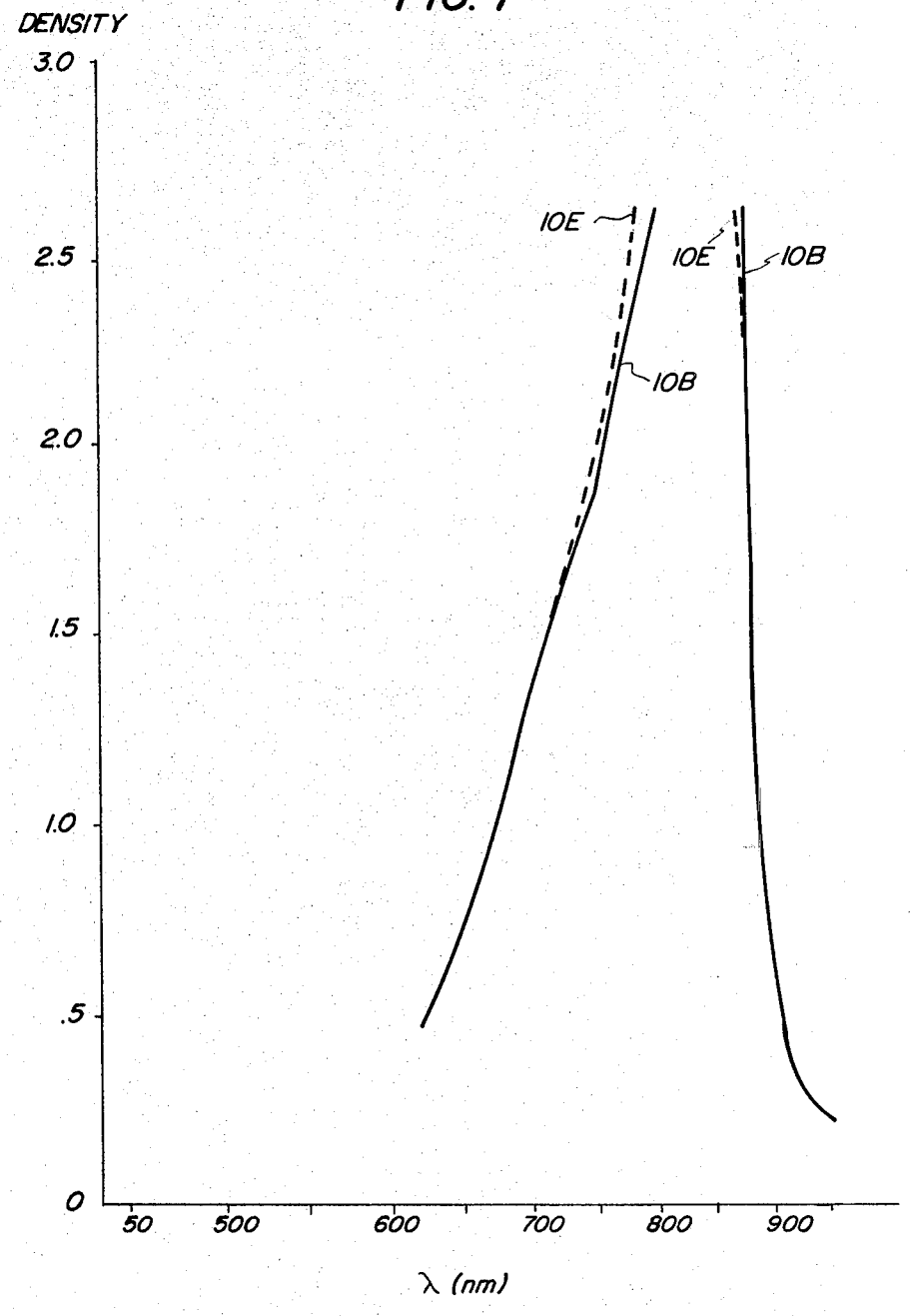
Figure 8:
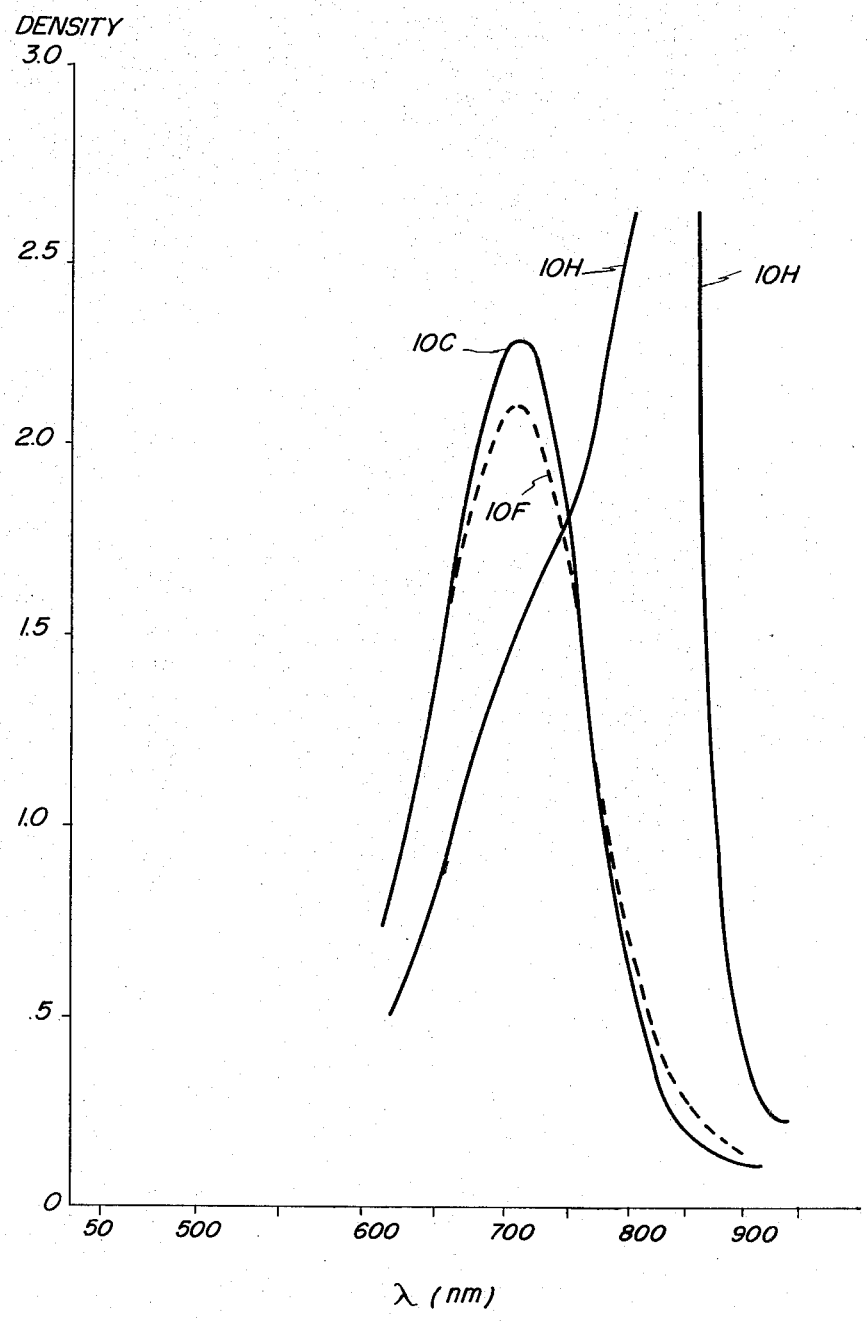

D. In FIG. 6 comparable density versus wavelength curves are plotted for the photographic element samples 10A, 10D, 10G which contained the coupler solvent tri-o-cresyl phosphate. A broadened absorption peak in the 650 to 850 region of the spectrum is obtained with the density being above 1 in all cases when the coupler to coupler solvent ratio is 1:1 or higher, but a shorter wavelength absorption peak without visible broadening is obtained when the coupler to coupler solvent ratio is 1:2. In FIG. 7 a broad absorption peak in excess of a density of 1 is obtained throughout the spectral region of from about 700 to 850 nm. This is obtained with both a 1:2 and a 1:1 ratio of coupler to coupler solvent. In FIG. 8 a broad absorption peak in the region of from about 700 to 850 nm is observed exceeding a density of 1 when the ratio of coupler to coupler solvent is 2:1, but with coupler to coupler solvent ratios of 1:2 and 1:1 a lower wavelength absorption peak is observed with no evidence of broadening. These figures clearly demonstrate each of the three coupler solvents to be suitable for use in the practice of this invention in at least one concentration level investigated.

EXAMPLE 11

A. A photographic element was prepared having the general structure as Photographic Element 5-A (Example 5), but Coupler 1 substituted for Coupler 2.

B. A sample of the photographic element was exposed for 2 seconds at a color temperature of 3000° K. with an Eastman 1B sensitometer through a graduated density test object. The test object had 21 equal density steps from 0 density at Step 1 to a density of 6.0 at Step 1.

C. The exposed sample of the element was processed at 40° C. in the following manner:

The sample was immersed for 3 minutes in a black-and-white developer of the composition set forth in Table XIV.

TABLE XIV

| Black-and-White Developer | | |
|---|---|---|
| 1.0 | g | Sodium hexametaphosphate |
| 25.0 | g | Sodium sulfite |
| 0.6 | g | 4-Hydroxymethyl-4-methyl-1-phenyl-3-pyrazolidone |
| 16.0 | g | Potassium carbonate (anhydrous) |
| 11.6 | g | Hydroquinone monosulfonate sodium salt |

TABLE XIV-continued

| Black-and-White Developer | | |
|---|---|---|
| 1.5 | g | Sodium bromide |
| 12.0 | g | Sodium bicarbonate |
| 0.007 | g | 0.1% Potassium iodide solution |
| 0.60 | g | Sodium thiocyanate |
| Water to 1 liter, pH to 9.6 | | |

The sample was immersed for 30 seconds in a stop bath of pH 3.0 formed by 30 ml of acetic acid in 1 liter of water, washed in water for 1 minute and then immersed for 20 seconds in a reversal bath of the composition set forth in Table XV.

TABLE XV

| Reversal Bath | | |
|---|---|---|
| 5.0 | g | Borax |
| 5.0 | g | Boric acid |
| 11 | ml | 1.4% t-Buytlamine borane solution |
| Water to 1 liter, pH to 8.5 | | |

The sample was washed in water for 30 seconds and then immersed for 8 minutes in a color developer of the composition set forth in Table XVI.

TABLE XVI

| Color Developer | | |
|---|---|---|
| 800 | ml | Water |
| 4.5 | g | Potassium sulfite |
| 5.0 | g | 4-Amino-3-methyl-N-ethyl-N-β-(methanesulfonamido)-ethylaniline sulfate hydrate |
| 30.0 | g | Potassium carbonate (anhydrous) |
| 0.75 | g | Potassium bromide |
| 0.03 | g | Potassium iodide |
| 1.5 | g | Citrazinic acid |
| 1.0 | g | 3,6-Dithiaoctanediol |
| Water to 1 liter, pH to 10.0 | | |

The sample was again immersed in the stop bath for 2 minutes, washed for 2 minutes in water and immersed in a bleach bath of the composition set forth in Table XVII.

TABLE XVII

| Bleach Bath | | |
|---|---|---|
| 21.5 | g | Sodium bromide |
| 100.0 | g | Potassium ferricyanide |
| 0.07 | g | $NaHPO_4 \cdot H_2O$ |
| Water to 1 liter, pH to 7.0 | | |

The sample was immersed in a fix bath of the composition set forth in Table XVIII, washed for 2 minutes in water and allowed to dry.

TABLE XVIII

| Fix Bath | | |
|---|---|---|
| 250.0 | g | $Na_2S_2O_3 \cdot 10H_2O$ |
| 1.5 | g | Sodium bisulfite |
| 6.0 | g | Sodium sulfite |
| Water to 1 liter, pH to 7.0 | | |

Figure 9:
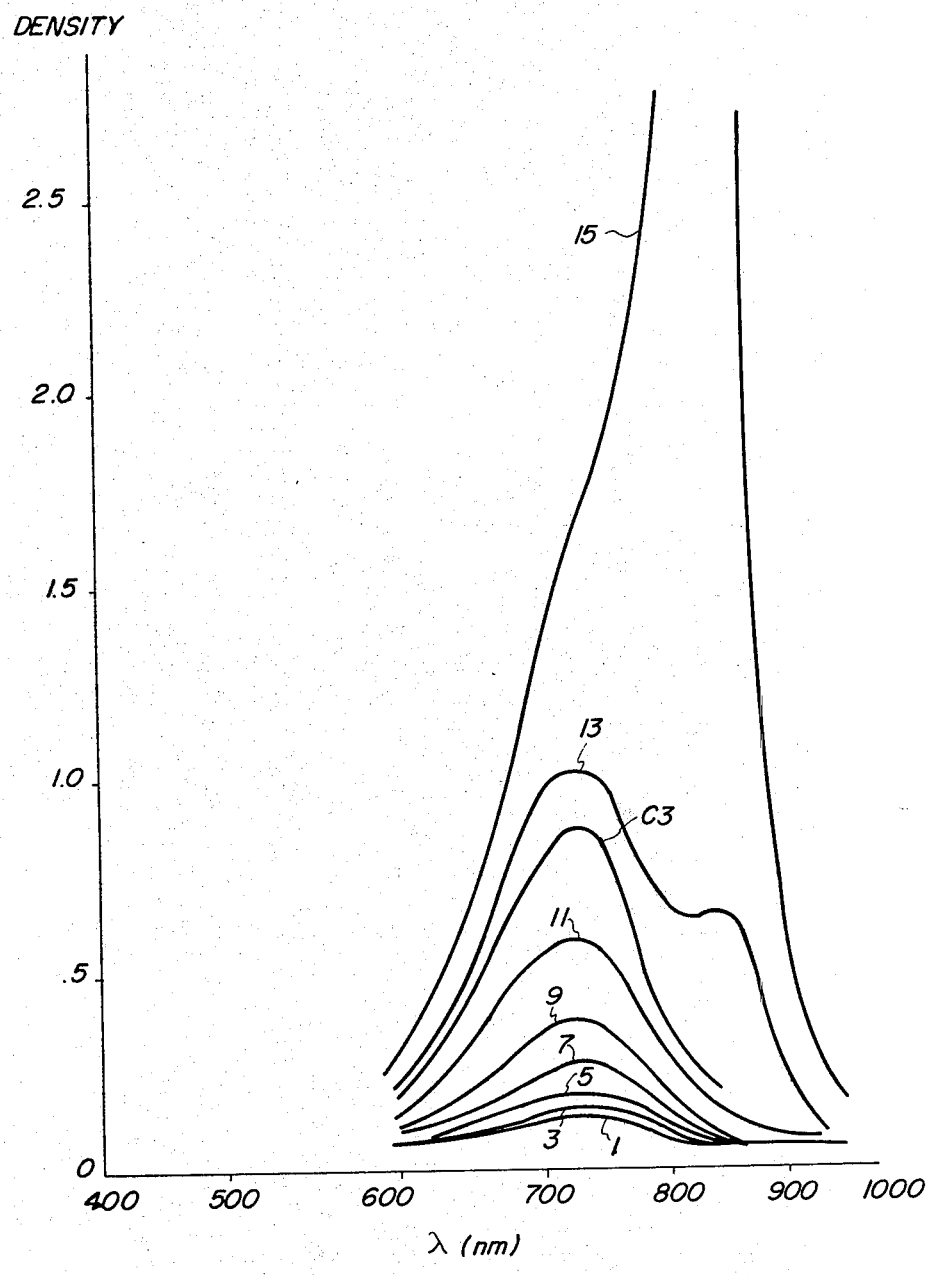

D. In FIG. 9 a plot of density versus wavelength of dye absorption is shown. The reference numerals applied to the curves refer to the step number of the step tablet through which that portion of the sample was exposed. It can be seen that where low maximum dye densities were produced the absorption peak produced by the dye was in the vicinity of about 725 nm and of relatively narrow breadth. By the time peak dye density had read a maximum value of about 1 a broadening of the absorption peak was clearly in evidence. In Curve 13 two separate peaks are clearly in evidence and in Curve 15 the maximum absorption peak provides a density in excess of 1 over the spectral region of about 660 to 900 nm. Higher numbered curves, not shown, provided higher density, broader absorption peaks.

EXAMPLE 12

A. A sample of 1-hydroxy-2-(3-octadecylsulfamoyl)-naphthanilide, hereinafter designated Coupler 6, was prepared in the following manner:

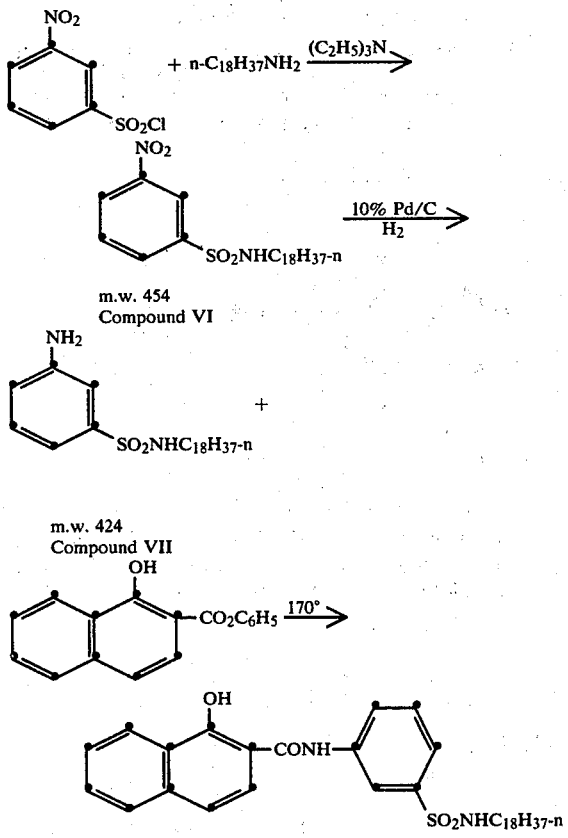

To a solution of 80.7 g (0.3 mole) of octadecylamine and 33.3 g triethylamine in 700 ml dry tetrahydrofuran, a solution of 66.45 g (0.3 mole) m-nitrobenzene sulfonyl chloride in 100 ml dry tetrahydrofuran is added dropwise with stirring under nitrogen. The reaction mixture was cooled with an ice water bath. At the completion of the addition (approximately one-half hour), the ice bath was removed, and the reaction stirred overnight at ambient temperature.

The reaction mixture was then added to approximately 1 liter ice water containing 60 ml concentrated hydrochloric acid. The resulting slurry was filtered by vacuum and the white solid air-dryed. The white solid was then recrystallized from methanol to yield 109.9 g (81 percent) of a white crystaline solid, m.p. 98°–100° C. Analysis indicated essentially pure component material.

45.4 g (0.1 mole) of Compound VI and 5 teaspoons of carbon supported Pd in 250 ml dry tetrahydrofuran was hydrogenated at 278 kPa until the required amount of $H_2$ was taken up, hydrogen pressure being reduced in this process to 110 kPa (16 psi). This took approximately 2 hours. The reaction mixture was then filtered through celite and the resulting solution evaporated to dryness in vacuo. The resulting solid was recrystallized from 500 ml methanol to yield 37.0 g (87 percent yield) of a white crystaline material, m.p. 96°–98° C.

25.44 g (0.06 mole) of Compound VII and 15.84 g (0.06 mole) of the phenyl ester were mixed in a 200 ml round bottom flask fitted with a gas take-off tube. This flask was then placed in an oil bath previously heated to 170° C. and the gas take-off connected to a water aspirator in order to remove phenol liberated during the reaction.

The reaction mixture was heated at 170° C. for approximately 1 hour after which time no additional phenol was observed distilling off.

The reaction mixture was cooled to room temperature and recrystallized three times from ethyl acetate to yield 10.6 g (30 percent) of an off-white solid, m.p. 176°–178° C. Elemental analysis for carbon, hydrogen, nitrogen and sulfur were in agreement with the theoretical values for this compound.

B. For purposes of comparison, a sample of the following coupler, hereinafter designated Control Coupler 2 (C-2), was employed:

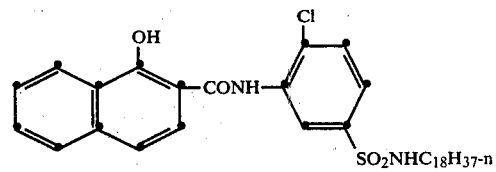

Control Coupler 2

C. Four separate photographic elements having a transparent film support and a gelatino-silver halide emulsion layer and a clear gelatin overcoat layer coated thereon were prepared having the general structure shown below in Table XIX. The coupler, the coupler solvent and its concentration are separately listed in Table XX.

TABLE XIX

| Photographic Elements 12A-D |
|---|
| Gelatino-Silver Halide Emulsion Layer: Silver Bromoiodide (0.912); Gelatin (3.78); Coupler (See Table XX) 1.61 m moles/m$^2$; Coupler Solvent (See Table XX) |

TABLE XX

| Element | Coupler | Coupler Solvent (CS) | Coupler:CS | CS Coverage |
|---|---|---|---|---|
| 12A | 6 | Di-n-butylphthalate | 1:2 | 1.92 |
| 12B | 6 | N,N-diethyl lauramide | 2:1 | 0.48 |
| 12C | C-2 | Di-n-butylphthalate | 1:2 | 2.02 |
| 12D | C-2 | N,N-diethyl lauramide | 2:1 | 0.51 |

The coupler was dispersed in the coupler solvent which was in turn dispersed in particulate form in the gelatin of the silve halide emulsion.

D. Each sample of the photographic element was exposed for 2 seconds at a color temperature of 3000° K. with an Eastman 1B sensitometer through a graduated density test object. The test object had 21 equal density steps from 0 density at Step 1 to a density of 6.0 at Step 21.

E. The exposed samples of the photographic element were then identically processed at 40° C. in the following manner:

Each sample was developed for 2 minutes in the color developer set forth in Table XXI.

TABLE XXI

| Color Developer | | |
|---|---|---|
| 2.0 | g | Potassium sulfite |
| 5.0 | g | 4-Amino-3-methyl-N-ethyl-N-(methanesulfonamido)ethylaniline sulfate hydrate |
| 30 | g | Potassium carbonate (anhydrous) |
| 1.25 | g | Potassium bromide |
| 0.0006 | g | Potassium iodide |
| Water to 1 liter,pH 10.0 | | |

Each sample was washed in water for 2 minutes and immersed for 2 minutes in a bleach bath of the composition set forth in Table XXII.

TABLE XXII

| Bleach Bath | | |
|---|---|---|
| 21.5 | g | Sodium bromide |
| 100.0 | g | Potassium ferricyanide |
| 0.07 | g | $NaH_2PO_4 \cdot H_2O$ |
| Water to 1 liter, pH 7.0 | | |

Each sample was washed in water for 2 minutes and immersed for 2 minutes in a fix bath of the composition set forth in Table XXIII.

TABLE XIII

| Fix Bath | | |
|---|---|---|
| 250.0 | g | $Na_2S_2O_3 \cdot 10H_2O$ |
| 1.5 | g | Sodium bisulfite |
| 6.0 | g | Sodium sulfite |
| Water to 1 liter, pH 7.0 | | |

Each sample was washed in water for 2 minutes and allowed to dry at room temperature.

Figure 10:
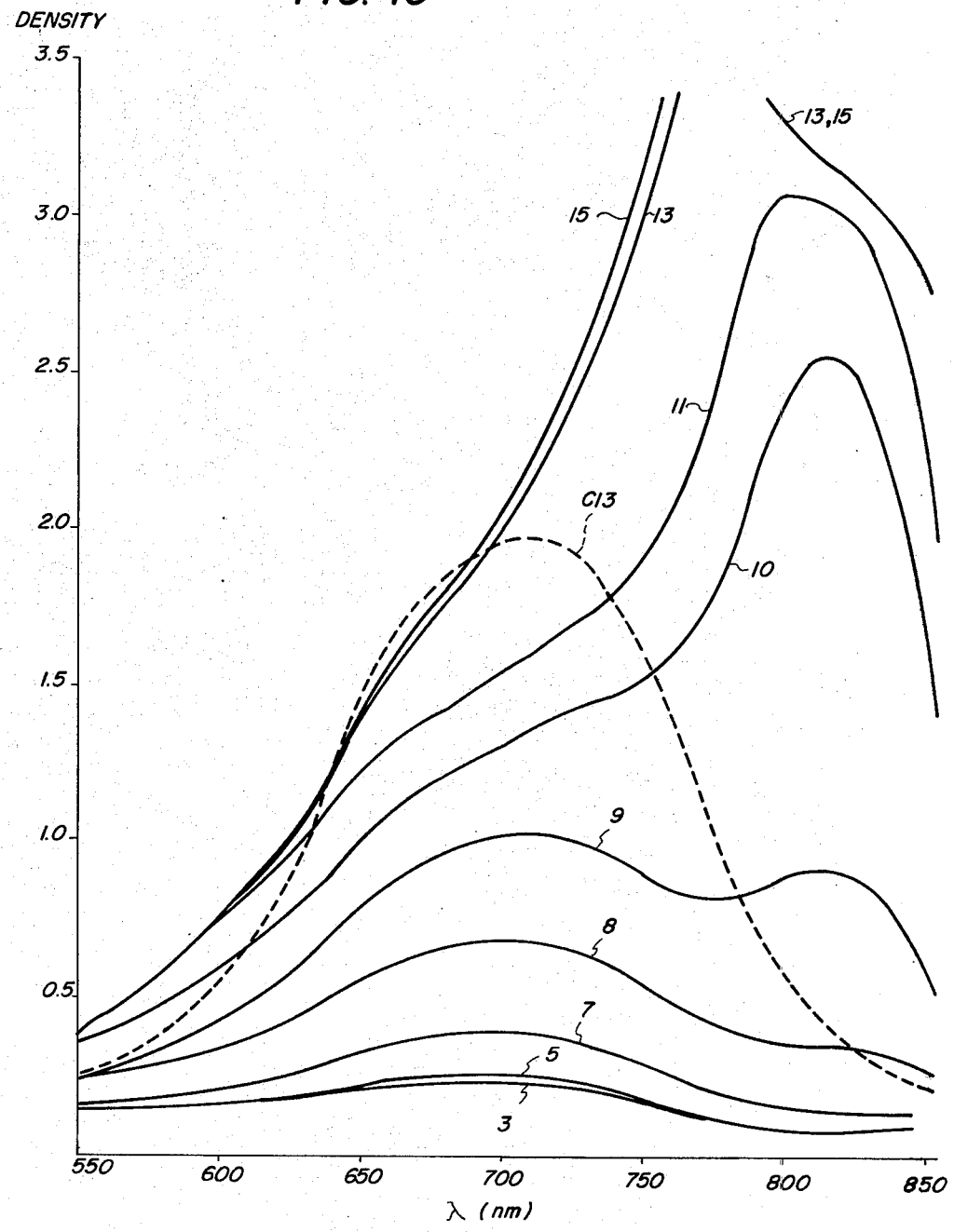
Figure 11:
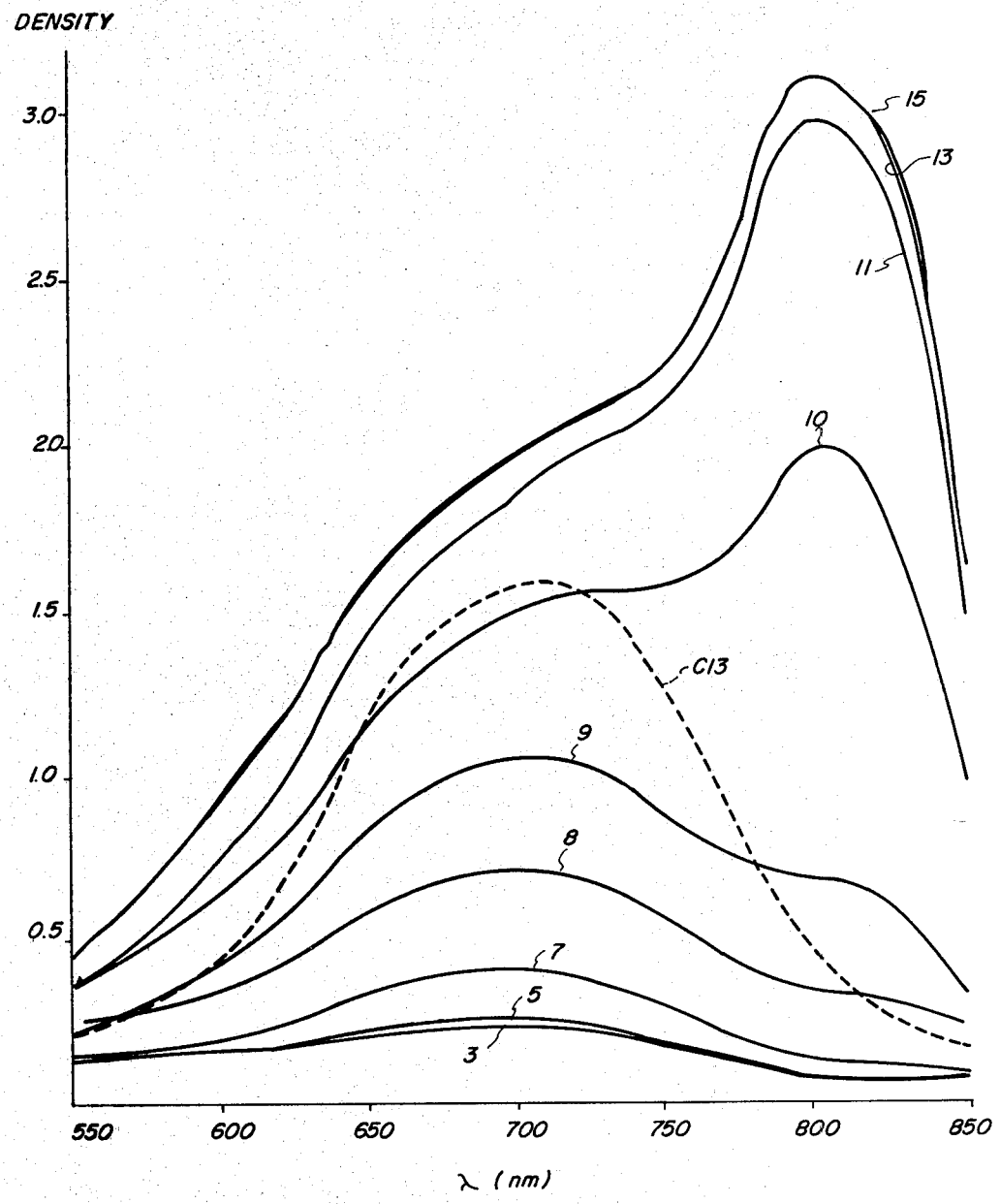

F. In FIGS. 10 and 11 a plot of density versus wavelength of dye absorption is shown. The reference numerals applied to the curves refer to the step number of the step tablet through which that portion of the sample was exposed.

In FIG. 10, the curves are plotted for the photographic element samples 12A and 12C (Coupler 6 and Control Coupler 2, respectively) which contained the coupler solvent di-n-butylphthalate, coupler to coupler solvent ratio 1:2. It can be seen that a broadened absorption peak in the 750 to 850 region of the spectrum is obtained with the density being above 1 for Coupler 6. In Curve C13 and lower numbered curves, not shown, the maximum absorption peak produced was in the vicinity of about 710 nm for Control Coupler 2.

Similiar results were obtained for photographic element samples 12B and 12D (Coupler 6 and Control Coupler 2, respectively) which contained the coupler solvent N,N-diethyl lauramide, coupler to coupler solvent ratio 2:1. As shown in FIG. 11, a broadened absorption peak in the 750 to 850 region of the spectrum is obtained with the density being above 1 for Coupler 6. In Curve C13 and lower numbered curves, not shown, the maximum absorption peak produced was in the vicinity of about 710 nm for Control Coupler 2.

From FIGS. 10 and 11, it is apparent that Coupler 6 was effective in producing a dye having a much broadened bathochromic absorption relative to the dye formed by Control Coupler 2, which remained to absorb at a maximum of about 710 nm and failed to shift to longer wavelengths.

The invention has been described in detail with particular reference to preferred embodiments thereof but it will be understood that variations and modifications can be effected within the spirit and scope of the invention.

What is claimed is:

1. In a silver halide photographic element comprising a support and, coated thereon, at least one layer unit which comprises a photographic silver halide emulsion layer and coupler solvent particles dispersed in a photographically useful amount in said emulsion layer or in an adjacent hydrophilic colloid layer, the improvement wherein said coupler solvent particles are comprised of a combination, capable of permitting the formation of a microcrystalline dye, of a coupler of the formula

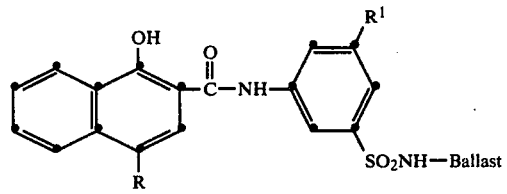

wherein

R is a coupling-off group, $R^1$ is either hydrogen or —$SO_2NH$—Ballast and

Ballast is a hydrophobic photographic ballasting group and a coupler solvent chosen from the group consisting of

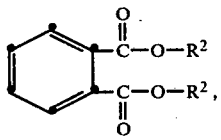

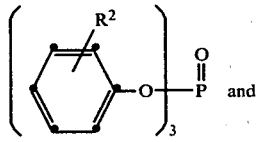

and

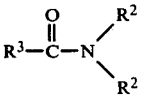

wherein $R^2$ is hydrogen or lower alkyl of from 1 to 6 carbon atoms and is lower alkyl in at least one occurrence, and $R^3$ is a straight-chain alkyl group of from 7 to 15 carbon atoms, said coupler and said coupler solvent being present in a weight ratio in the range of from 5:1 to 1:2.

2. An improved photographic element according to claim 1 wherein the ballast groups have from 8 to 32 carbon atoms in aggregate.

3. An improved photographic element according to claim 1 wherein each ballast group is a straight-chain alkyl group of from 6 to 16 carbon atoms.

4. An improved photographic element according to claim 1 wherein the ballast groups are of the formula:

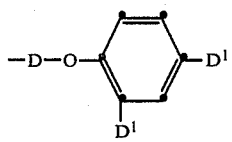

wherein

D is a divalent lower alkylene group of from 1 to 6 carbon atoms and $D^1$ is a monovalent lower alkyl group of from 1 to 6 carbon atoms.

5. An improved photographic element according to claim 1 wherein $R^1$ is hydrogen.

6. An improved photographic element according to claim 1 wherein $R^1$ is —$SO_2NH$—Ballast.

7. An improved photographic element according to claim 1 wherein said silver halide emulsion layer is sensitized to the infrared portion of the spectrum.

8. An improved photographic element according to claim 1 wherein said element includes at least three layer units, one spectrally responsive to the blue region of the spectrum and containing a yellow dye-forming coupler, one spectrally responsive to the green region of the spectrum and containing a magenta dye-forming coupler and one spectrally responsive to the red region of the spectrum and containing a cyan dye-forming coupler.

9. An improved photographic element according to claim 1 wherein said coupler is present in a concentration sufficient to yield a maximum dye density of at least 1 at the 800 nm region of the spectrum.

10. An improved photographic element according to claim 1 wherein said coupler is present in a concentration of from 0.40 to 1.30 grams per square meter.

11. In a silver halide photographic element comprising a support and, coated thereon, at least one layer unit which comprises a photographic silver halide emulsion layer containing coupler solvent particles dispersed therein, the improvement wherein said coupler solvent particles are comprised of a combination, capable of permitting the formation of a microcrystalline dye, of a coupler of the formula

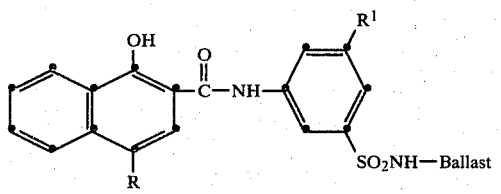

wherein $R^1$ is either hydrogen or —$SO_2NH$—Ballast and

Ballast is either a straight chain alkyl group of from 6 to 16 carbon atoms or

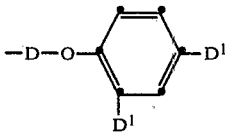

wherein D is a divalent lower alkylene group of from 1 to 6 carbon atoms and $D^1$ is a monovalent lower alkyl group of from 1 to 6 carbon atoms and a coupler solvent of the formula

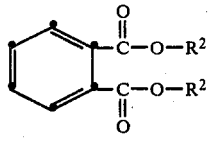

wherein $R^2$ is hydrogen or lower alkyl of from 1 to 6 carbon atoms and is lower alkyl in at least one occurrence;

said coupler and said coupler solvent being present in a weight ratio of from 1:1 to 1:2 and said coupler being present in a concentration of from 0.65 to 1.05 grams per square meter.

12. An improved photographic element according to claim 11 wherein D is butylene, $D^1$ is amyl and $R^2$ is butyl.

13. In a silver halide photographic element comprising a support and, coated thereon, at least one layer unit which comprises a photographic silver halide emulsion layer containing coupler solvent particles dispersed therein, the improvement wherein said coupler solvent particles are comprised of a combination, capable of permitting the formation of a microcrystalline dye, of a coupler of the formula

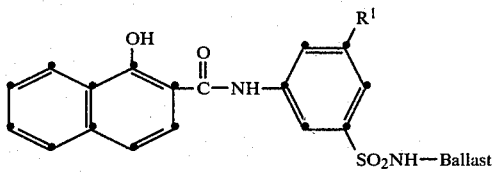

wherein $R^1$ is either hydrogen or —$SO_2NH$—Ballast and

Ballast is either a straight chain alkyl group of from 6 to 16 carbon atoms or

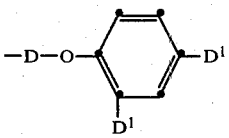

wherein D is a divalent lower alkylene group of from 1 to 6 carbon atoms and $D^1$ is a monovalent lower alkyl group, of from 1 to 6 carbon atoms and a coupler solvent of the formula

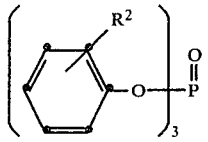

wherein $R^2$ is hydrogen or lower alkyl of from 1 to 6 carbon atoms and is lower alkyl in at least one occurrence;

said coupler and said coupler solvent being present in a weight ratio of from 4:1 to 1:1 and said coupler being present in a concentration of from 0.65 to 1.05 grams per square meter.

14. An improved photographic element according to claim 13 wherein D is butylene, $D^1$ is amyl and $R^2$ is methyl.

15. In a silver halide photographic element comprising a support and, coated thereon, at least one layer unit which comprises a photographic silver halide emulsion layer containing coupler solvent particles dispersed therein, the improvement wherein said coupler solvent particles are comprised of a combination, capable of permitting the formation of a microcrystalline dye, of a coupler of the formula

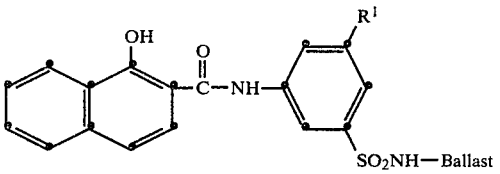

wherein $R^1$ is either hydrogen or —$SO_2NH$—Ballast and

Ballast is either a straight chain alkyl group of from 6 to 16 carbon atoms or

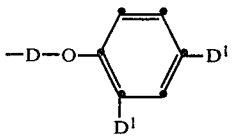

wherein D is a divalent lower alkylene group of from 1 to 6 carbon atoms and $D^1$ is a monovalent lower alkyl group of from 1 to 6 carbon atoms and a coupler solvent of the formula

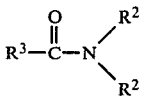

wherein $R^2$ is hydrogen or lower alkyl of from 1 to 6 carbon atoms and $R^3$ is a straight-chain alkyl group of from 7 to 15 carbon atoms;

said coupler and said coupler solvent being present in a weight ratio of from 4:1 to 2:1 and said coupler being present in a concentration of from 0.65 to 1.05 grams per square meter.

16. An improved photographic element according to claim 15 wherein $R^3$ is from 9 to 13 carbon atoms, D is butylene and $D^1$ is amyl.

17. A composition which can be coated to form a layer of a photographic element comprising a hydrophilic colloid and coupler solvent particles dispersed therein in a photographically useful amount comprised of a combination, capable of permitting the formation of a microcrysalline dye, of a coupler of the formula

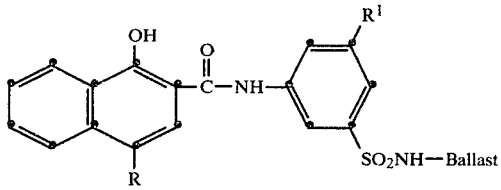

wherein

R is a coupling-off group, $R^1$ is either hydrogen or —$SO_2NH$—Ballast and

Ballast is a hydrophobic photographic ballasting group and a coupler solvent chosen from the group consisting of

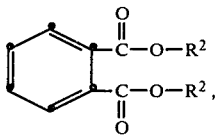

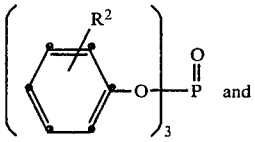

and

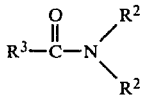

wherein $R^2$ is hydrogen or lower alkyl of from 1 to 6 carbon atoms and is lower alkyl in at least one occurrence, and $R^3$ is a straight-chain alkyl group of from 7 to 15 carbon atoms;

said coupler and said coupler solvent being present in a weight ratio in the range of from 5:1 to 1:2.

18. A gelatino-silver halide emulsion which can be coated to form a layer of a photographic element comprising coupler solvent particles dispersed therein in a photographically useful amount comprised of a combination, capable of permitting the formation of a microcrystalline dye, of a coupler chosen from the group comprising m-[N-δ-(2′,4′-di-amylphenoxy)butylsulfamoyl]-1-hydroxy-2-naphthanilide, m-{N-[β-(2,4-di-amylphenoxy)butylsulfamoyl]}-1-hydroxy-2-naphthanilide, di-[m-(N-dodecyl)sulfamoyl]-1-hydroxy-2-naphthanilide and di-[m-(N-octyl)sulfamoyl]-1-hydroxy-2-naphthanilide and a coupler solvent chosen from the group comprising dibutyl phthalate, tricresyl phosphate and N,N-diethyl lauramide; and said coupler and said coupler solvent being present in a weight ratio in the range of from 5:1 to 1:2.

19. A gelatino-silver halide emulsion according to claim 18 wherein said coupler solvent is dibutyl phthalate and said coupler and said coupler solvent are present in a weight ratio of from 1:1 to 1:2.

20. A gelatino-silver halide emulsion according to claim 18 wherein said coupler solvent is tricresyl phosphate and said coupler and said coupler solvent are present in a weight ratio of from 4:1 to 1:1.

21. A gelatino-silver halide emulsion according to claim 18 wherein said coupler solvent is N,N-diethyl lauramide and said coupler and said coupler solvent are present in a weight ratio of from 4:1 to 2:1.

* * * * *